US011104141B2

(12) United States Patent
Mataki

(10) Patent No.: US 11,104,141 B2
(45) Date of Patent: Aug. 31, 2021

(54) LIQUID JETTING DEVICE, LIQUID JETTING HEAD CLEANING DEVICE, AND LIQUID JETTING HEAD CLEANING METHOD

(71) Applicant: FUJIFILM Corporation, Tokyo (JP)

(72) Inventor: Hiroshi Mataki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 31 days.

(21) Appl. No.: 16/826,281

(22) Filed: Mar. 22, 2020

(65) Prior Publication Data

US 2020/0215821 A1 Jul. 9, 2020

Related U.S. Application Data

(63) Continuation of application No. PCT/JP2018/035319, filed on Sep. 25, 2018.

(30) Foreign Application Priority Data

Sep. 27, 2017 (JP) ..... JP2017-186559

(51) Int. Cl.
*B41J 2/165* (2006.01)

(52) U.S. Cl.
CPC ..... *B41J 2/16535* (2013.01); *B41J 2/16505* (2013.01); *B41J 2/16552* (2013.01); *B41J 2002/16558* (2013.01)

(58) Field of Classification Search
CPC ..... B41J 2/16535; B41J 2/16552; B41J 2/16505; B41J 2/16517; B41J 2002/16558
See application file for complete search history.

(56) References Cited

U.S. PATENT DOCUMENTS 9,174,451 B2 11/2015 Hara et al.
2010/0245466 A1* 9/2010 Inoue ..... B41J 2/16535 347/30

(Continued)

FOREIGN PATENT DOCUMENTS

JP H106965 1/1994
JP 2005288847 10/2005

(Continued)

OTHER PUBLICATIONS

"International Search Report (Form PCT/ISA/210) of PCT/JP2018/035319 ," dated Nov. 20, 2018, with English translation thereof, pp. 1-5.

(Continued)

*Primary Examiner* — Sharon Polk
(74) *Attorney, Agent, or Firm* — JCIPRNET

(57) ABSTRACT

Provided are a liquid jetting device, a liquid jetting head cleaning device, and a liquid jetting head cleaning method, in which an increase in the number of jetting failures is suppressed in a case where a nozzle surface of a liquid jetting head is cleaned by causing a napped wiping member to abut against the nozzle surface.

The problem is solved by a liquid jetting head cleaning device, in which first cleaning is performed on a liquid jetting head by causing a napped wiping member to abut against a nozzle surface of the liquid jetting head, second cleaning is performed on the liquid jetting head by causing a liquid to be first pre-jetted from a nozzle of the liquid jetting head after the first cleaning and causing an unnapped wiping member to abut against the nozzle surface of the liquid jetting head after the first pre-jetting, the liquid is pre-jetted from the nozzle of the liquid jetting head after the (Continued)

second cleaning, and the number of times of jetting in the first pre-jetting is larger than the number of times of jetting in the second pre-jetting.

12 Claims, 17 Drawing Sheets

(56) References Cited

U.S. PATENT DOCUMENTS

| | | | | |
|---|---|---|---|---|
| 2013/0250000 | A1* | 9/2013 | Yamamoto | B41J 2/16538 347/33 |
| 2015/0298475 | A1* | 10/2015 | Kuypers | B41J 2/16535 347/19 |
| 2017/0120600 | A1* | 5/2017 | Yamanobe | B41J 2/16552 |
| 2017/0151789 | A1* | 6/2017 | Yamanobe | B41J 2/16535 |

FOREIGN PATENT DOCUMENTS

| | | |
|---|---|---|
| JP | 2014180860 | 9/2014 |
| JP | 2015054496 | 3/2015 |
| JP | 2015089658 | 5/2015 |
| JP | 2016159425 | 9/2016 |
| JP | 2017136795 | 8/2017 |
| WO | 2017072134 | 5/2017 |

OTHER PUBLICATIONS

"Written Opinion of the International Searching Authority (Form PCT/ISA/237) of PCT/JP2018/035319 ," dated Nov. 20, 2018, with English translation thereof, pp. 1-7.

* cited by examiner

LIQUID JETTING DEVICE, LIQUID JETTING HEAD CLEANING DEVICE, AND LIQUID JETTING HEAD CLEANING METHOD

CROSS-REFERENCE TO RELATED APPLICATIONS

The present application is a Continuation of PCT International Application No. PCT/JP2018/035319 filed on Sep. 25, 2018 claiming priority under 35 U.S.C § 119(a) to Japanese Patent Application No. 2017-186559 filed on Sep. 27, 2017. Each of the above applications is hereby expressly incorporated by reference, in its entirety, into the present application.

BACKGROUND OF THE INVENTION

1. Field of the Invention

The present invention relates to a liquid jetting device, a liquid jetting head cleaning device, and a liquid jetting head cleaning method, and particularly to a liquid jetting device, a liquid jetting head cleaning device, and a liquid jetting head cleaning method, in which a liquid jetting head is cleaned by using a napped wiping member.

2. Description of the Related Art

In a case where a nozzle surface of a liquid jetting head is contaminated by a residue of a liquid, there is a possibility that a jetting failure occurs in a nozzle formed on the nozzle surface in a liquid jetting device. For this reason, it is necessary to periodically clean the nozzle surface.

As a method of cleaning the nozzle surface, a method of wiping the nozzle surface by a wiping member is known. In addition, in order to wipe the nozzle surface by using an unused region of the wiping member at all times, the nozzle surface is wiped while the wiping member is being transported.

However, even in a case where the wiping member wipes the nozzle surface, a residue which is left and solidified inside the nozzle cannot be removed. For this reason, the clogging of the nozzle cannot be solved in some cases.

A cleaning device comprising a cleaning member capable of cleaning a jetting head by coming into contact with a region including a nozzle surface of the jetting head (corresponds to the liquid jetting head) which jets a liquid from a nozzle formed on the nozzle surface, in which a raised part (corresponds to the nap) in which a plurality of hairs are raised is formed in a portion coming into contact with the nozzle surface when the cleaning member cleans the jetting head, is disclosed in JP2015-089658A.

In the cleaning device of JP2015-089658A, distal ends of hairs of the raised part enter the nozzle and collide with a residue which is left and solidified inside the nozzle, and thus an effect of removing the residue can be improved.

SUMMARY OF THE INVENTION

However, in a case where wiping is performed by using the napped wiping member disclosed in JP2015-089658A, the number of jetting failures temporarily increases after wiping. This tendency is conspicuous in a case where an ink which is likely to be dried and solidified is used.

The present invention is devised in view of such circumstances, and an object thereof is to provide a liquid jetting device, a liquid jetting head cleaning device, and a liquid jetting head cleaning method, in which an increase in the number of jetting failures is suppressed in a case where a nozzle surface of a liquid jetting head is cleaned by causing a napped wiping member to abut against the nozzle surface.

According to an aspect of the invention, in order to achieve the object, there is provided a liquid jetting head cleaning device comprising a first cleaning unit that cleans a liquid jetting head by causing a napped wiping member to abut against a nozzle surface of the liquid jetting head of a liquid jetting device having a liquid tank which stores a liquid containing latex, the liquid jetting head which jets the liquid from a nozzle disposed on the nozzle surface, and a circulating unit which circulates the liquid between the liquid tank and the liquid jetting head, a first pre-jetting controller that causes the liquid to be pre-jetted from the nozzle of the liquid jetting head after cleaning by the first cleaning unit, a second cleaning unit that cleans the liquid jetting head by causing an unnapped wiping member to abut against the nozzle surface of the liquid jetting head after pre-jetting by the first pre-jetting controller, and a second pre-jetting controller that causes the liquid to be pre-jetted from the nozzle of the liquid jetting head after cleaning by the second cleaning unit. In the liquid jetting head cleaning device, the number of times of jetting in pre-jetting by the first pre-jetting controller is larger than the number of times of jetting in pre-jetting by the second pre-jetting controller.

According to the aspect, first cleaning is performed by using the napped wiping member, first pre-jetting is performed after the first cleaning, second cleaning in which the unnapped wiping member is used is performed after the first pre-jetting, second pre-jetting is performed after the second cleaning, and the number of times of jetting in the first pre-jetting is larger than the number of times of jetting in the second pre-jetting. For this reason, an increase in the number of jetting failures can be suppressed.

It is preferable that the first pre-jetting controller causes the liquid to be pre-jetted 10,000 times or more per nozzle. Accordingly, an increase in the number of jetting failures can be suppressed.

It is preferable that the second pre-jetting controller causes the liquid to be pre-jetted 200 times or less per nozzle. Accordingly, an increase in the number of jetting failures can be suppressed.

It is preferable that the liquid jetting head cleaning device further comprises a third pre-jetting controller that causes the liquid to be pre-jetted from the nozzle. It is preferable that the first cleaning unit cleans the liquid jetting head by using the napped wiping member in a wet state after pre-jetting by the third pre-jetting controller. Accordingly, an increase in the number of jetting failures after pre-jetting can be suppressed.

It is preferable that the liquid jetting head cleaning device further comprises a pressurization purging controller that performs pressurization purging for pressurizing an inside of the liquid jetting head to discharge the liquid from the nozzle. It is preferable that the first cleaning unit cleans the liquid jetting head by using the napped wiping member in a dry state after the pressurization purging. Accordingly, an increase in the number of jetting failures after pressurization purging can be suppressed.

It is preferable that the liquid jetting head is provided with a supply flow passage through which the liquid is supplied to a plurality of the nozzles, the plurality of the nozzles are divided into a plurality of groups, and out of the plurality of the nozzles to which the liquid is supplied from the same supply flow passage, the nozzles adjacent to each other belong to groups different from each other. It is preferable that the first pre-jetting controller causes the liquid to be pre-jetted from the nozzles at time points different for each of the groups. Accordingly, adherence of mist to the nozzle surface can be suppressed.

It is preferable that the liquid jetting head is provided with a circulation flow passage through which the liquid is collected from the plurality of the nozzles and the circulating unit supplies the liquid from the liquid tank to the supply flow passage and collects the liquid from the circulation flow passage to the liquid tank. Accordingly, the liquid can be appropriately pre-jetted from the nozzle of the liquid jetting head.

It is preferable that the napped wiping member is a long wiping web and the first cleaning unit causes the wiping web to abut against the nozzle surface via an abutting member, transports the wiping web with respect to the abutting member in a first direction, and moves the liquid jetting head relative to the abutting member in a second direction parallel to the nozzle surface to clean the liquid jetting head. Accordingly, the nozzle surface can be wiped by using an unused region of the napped wiping member at all times.

According to another aspect of the invention, in order to achieve the object, there is provided a liquid jetting device comprising a liquid tank that stores a liquid containing latex, a liquid jetting head that jets the liquid from a nozzle disposed on a nozzle surface, a circulating unit that circulates the liquid between the liquid tank and the liquid jetting head, a transporting unit that transports a recording medium, a recording controller that causes the liquid to be jetted from the nozzle of the liquid jetting head to the transported recording medium to record an image on the recording medium, a first cleaning unit that cleans the liquid jetting head by causing a napped wiping member to abut against the nozzle surface of the liquid jetting head, a first pre-jetting controller that causes the liquid to be pre-jetted from the nozzle of the liquid jetting head after cleaning by the first cleaning unit, a second cleaning unit that cleans the liquid jetting head by causing an unnapped wiping member to abut against the nozzle surface of the liquid jetting head after pre-jetting by the first pre-jetting controller, and a second pre-jetting controller that causes the liquid to be pre-jetted from the nozzle of the liquid jetting head after cleaning by the second cleaning unit. In the liquid jetting device, the number of times of jetting in pre-jetting by the first pre-jetting controller is larger than the number of times of jetting, in pre-jetting by the second pre-jetting controller.

According to the aspect, first cleaning is performed by using the napped wiping member, first pre-jetting is performed after the first cleaning, second cleaning in which the unnapped wiping member is used is performed after the first pre-jetting, second pre-jetting is performed after the second cleaning, and the number of times of jetting in the first pre-jetting is larger than the number of times of jetting in the second pre-jetting. For this reason, an increase in the number of jetting failures can be suppressed.

It is preferable that the liquid jetting device further comprises a maintenance unit that comprises a liquid receiving unit which receives the liquid caused to be pre-jetted by the first pre-jetting controller and the liquid caused to be pre-jetted by the second pre-jetting controller and a moving unit that moves the liquid jetting head between a recording position facing the transporting unit and a maintenance position facing the maintenance unit. It is preferable that the first cleaning unit and the second cleaning unit are disposed between the recording position and the maintenance position. By disposing in this manner, the liquid jetting head can be efficiently cleaned.

It is preferable that the liquid receiving unit is a moisturization cap that stores a moisturizing liquid and covers the nozzle surface to form a moisturization space between the nozzle surface and the moisturization cap. Accordingly, the moisturization cap can be used as the liquid receiving unit.

According to still another aspect of the invention, in order to achieve the object, there is provided a liquid jetting head cleaning method comprising a first cleaning step of cleaning a liquid jetting head by causing a napped wiping member to abut against a nozzle surface of the liquid jetting head of a liquid jetting device that has a liquid tank which stores a liquid containing latex, the liquid jetting head which jets the liquid from a nozzle disposed on the nozzle surface, and a circulating unit which circulates the liquid between the liquid tank and the liquid jetting head, a first pre-jetting control step of causing the liquid to be pre-jetted from the nozzle of the liquid jetting head after cleaning in the first cleaning step, a second cleaning step of cleaning the liquid jetting head by causing an unnapped wiping member to abut against the nozzle surface of the liquid jetting head after pre-jetting in the first pre-jetting control step, and a second pre-jetting control step of causing the liquid to be pre-jetted from the nozzle of the liquid jetting head after cleaning in the second cleaning step. In the liquid jetting head cleaning method, the number of times of jetting in pre-jetting of the first pre-jetting control step is larger than the number of times of jetting in pre-jetting of the second pre-jetting control step.

According to the aspect, first cleaning is performed by using the napped wiping member, first pre-jetting is performed after the first cleaning, second cleaning in which the unnapped wiping member is used is performed after the first pre-jetting, second pre-jetting is performed after the second cleaning, and the number of times of jetting in the first pre-jetting is larger than the number of times of jetting in the second pre-jetting. For this reason, an increase in the number of jetting failures can be suppressed.

In the present invention, an increase in the number of jetting failures can be suppressed in a case where the nozzle surface of the liquid jetting head is cleaned by causing the napped wiping member to abut against the nozzle surface.

DESCRIPTION OF THE PREFERRED EMBODIMENTS

Hereinafter, a preferable embodiment of the invention will be described in detail with reference to accompanying drawings.

<Ink Jet Recording Device>

Figure 1:
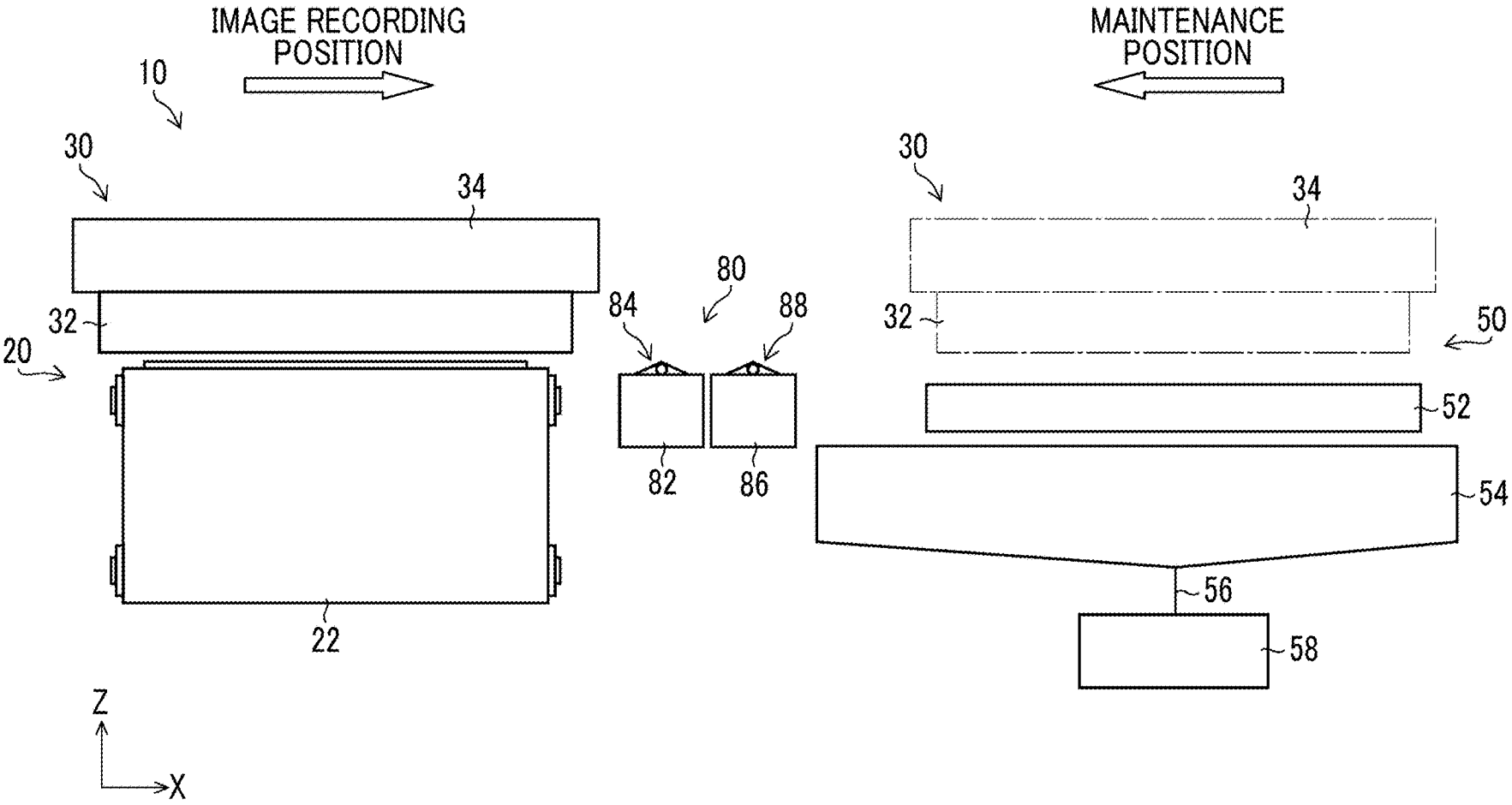
FIG. 1 is a front view of an ink jet recording device.
Figure 2:
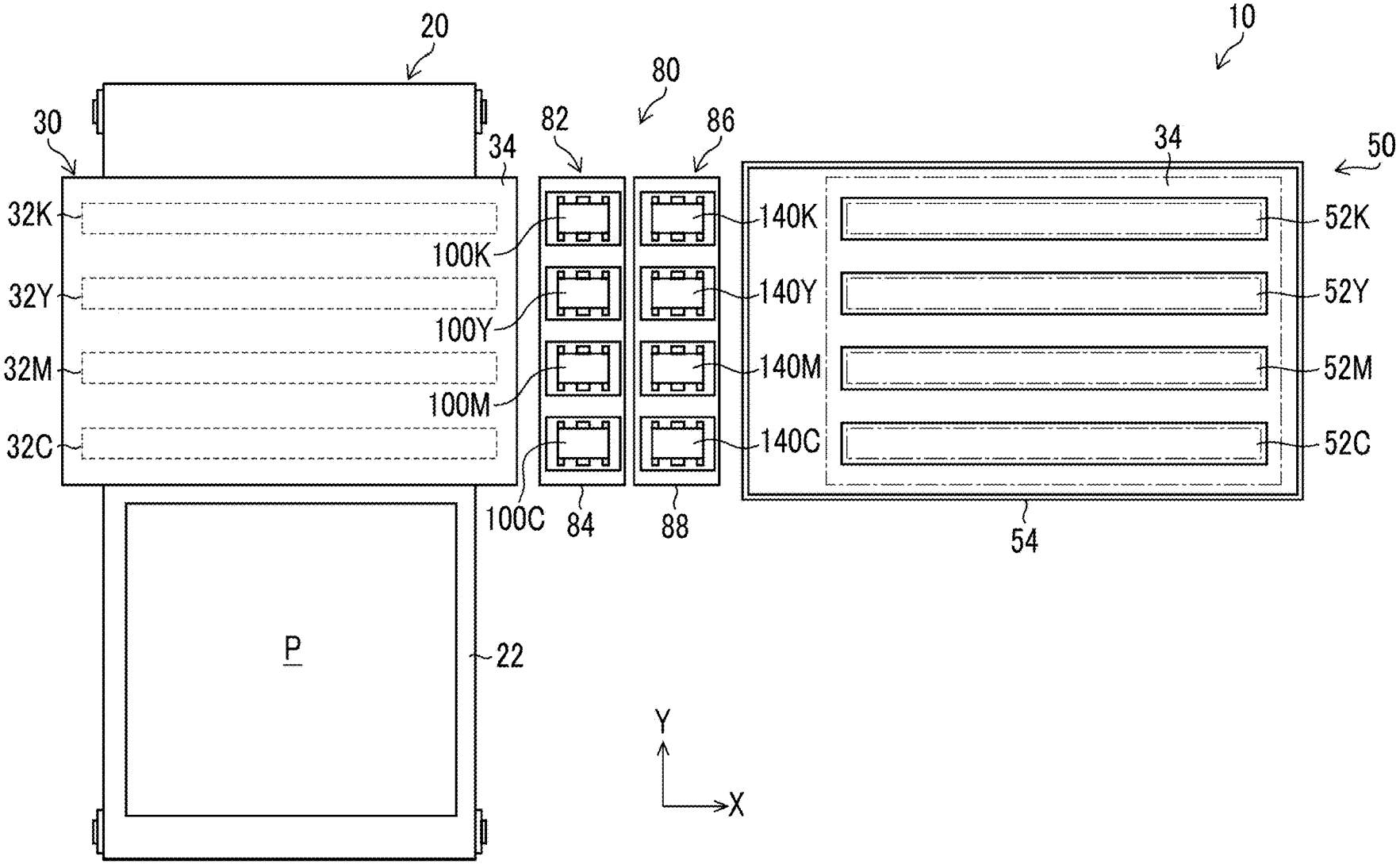
FIG. 2 is a plan view of the ink jet recording device.
Figure 3:
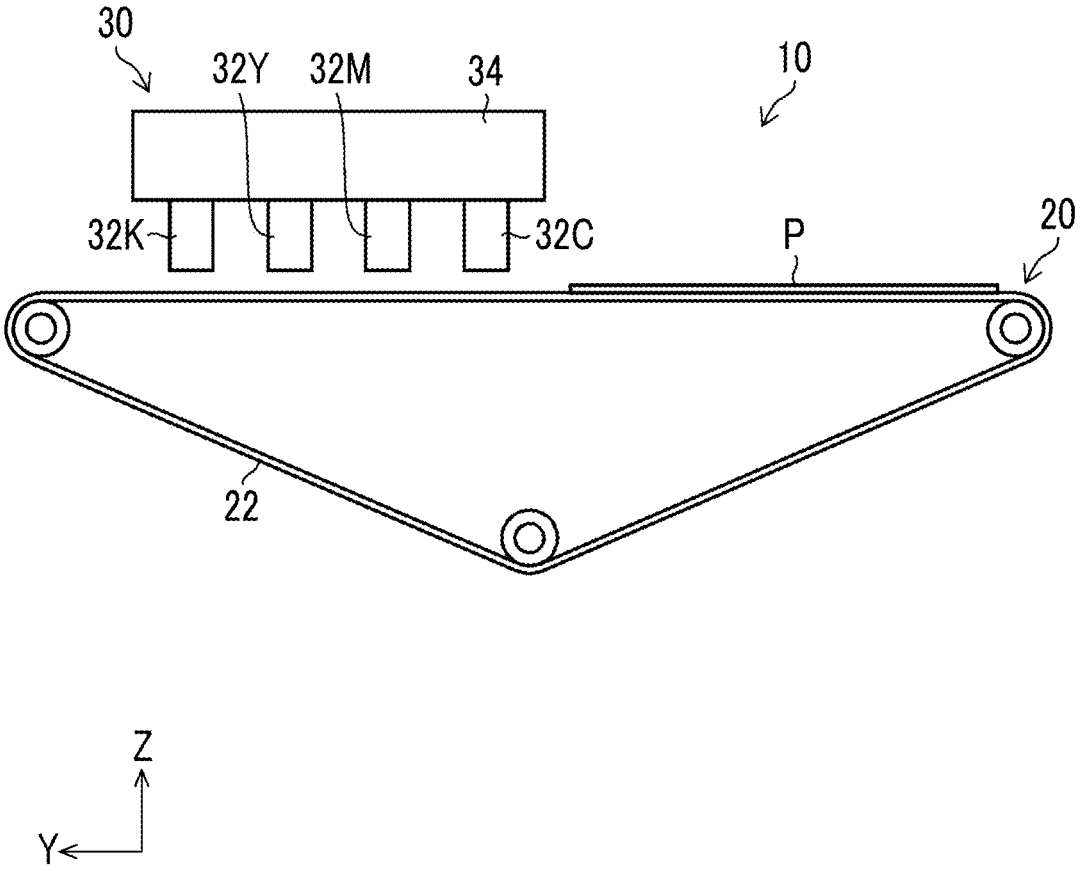
FIG. 3 is a side view of the ink jet recording device.

FIGS. 1 to 3 are a front view, a plan view, and a side view, each of which illustrates important parts of an ink jet recording device 10 according to the embodiment.

The ink jet recording device 10 (an example of a liquid jetting device) is a single-pass system line printer, and is configured to mainly comprise a sheet transporting unit 20 that transports a sheet P, which is a recording medium, a head unit 30 that comprises a plurality of ink jet heads 32C, 32M, 32Y, and 32K, an ink circulating unit 300 (refer to FIG. 8) that supplies an ink to the ink jet heads 32C, 32M, 32Y, and 32K in a circulating manner, a head moving unit 36 (refer to FIG. 12) that moves the head unit 30, a maintenance unit 50 that maintains the ink jet heads 32C, 32M, 32Y, and 32K, and a nozzle surface cleaning unit 80 that wipes and cleans nozzle surfaces of the ink jet heads 32C, 32M, 32Y and 32K included in the head unit 30.

The sheet transporting unit 20 causes a running belt 22 to adsorb the sheet P, thereby transporting the sheet P. A running route is set such that the belt 22 runs horizontally at some places. The sheet transporting unit 20 horizontally transports the sheet P by using places where the belt 22 runs horizontally. The sheet P is transported in a Y-direction in a horizontal posture by the sheet transporting unit 20.

The ink jet heads 32C, 32M, 32Y, and 32K jet cyan ink droplets, magenta ink droplets, yellow ink droplets, and black ink droplets, respectively. The ink jet heads 32C, 32M, 32Y, and 32K are mounted onto a head supporting frame 34.

The ink jet heads 32C, 32M, 32Y, and 32K each are configured as a line head that has a rectangular block shape and corresponds to a maximum sheet width of the sheet P, which is a printing target.

The head supporting frame 34 is attachably and detachably mounted onto a head mounting unit (not illustrated) for mounting each of the ink jet heads 32C, 32M, 32Y, and 32K.

In a case where the ink jet heads 32C, 32M, 32Y, and 32K are mounted onto the head supporting frame 34, nozzle surfaces 202 (refer to FIG. 6) of each ink jet head are disposed to be parallel to an XY-plane, which is a horizontal plane, and are disposed to be orthogonal to the Y-direction, which is a transporting direction of the sheet P, with a fixed interval along the Y-direction.

In addition, the head mounting unit is provided such that a position thereof in a Z-direction, which is a vertical direction, is adjustable. Height positions of the nozzle surfaces 202 of each of the ink jet heads 32C, 32M, 32Y, and 32K mounted on the head mounting unit are adjusted by adjusting the position of each head mounting unit in the Z-direction.

The head moving unit 36 (refer to FIG. 12) horizontally moves the head unit 30 in an X-direction (an example of a second direction) orthogonal to the Y-direction. For example, the head moving unit 36 is configured by a ceiling frame horizontally provided so as to straddle the sheet transporting unit 20, a guide rail laid on the ceiling frame, a running body that slidingly moves on the guide rail, and driving means that moves the running body along the guide rail. As the driving means, for example, a feed screw mechanism formed of a feed screw and a motor that rotation-drives the feed screw can be used. The head supporting frame 34 is mounted onto the running body, and the head unit 30 moves horizontally and slidingly.

The ink jet heads 32C, 32M, 32Y, and 32K included in the head unit 30 move between an "image recording position" and a "maintenance position" by the head unit 30 being driven by the head moving unit 36 to move horizontally.

At the image recording position, the ink jet heads 32C, 32M, 32Y, and 32K face the sheet P transported by the sheet transporting unit 20. The sheet is horizontally transported along one direction by the sheet transporting unit 20. In a case where the sheet P passes below the head unit 30 in the Z-direction, ink droplets are jetted to the sheet P from each of the ink jet heads 32C, 32M, 32Y, and 32K included in the head unit 30. Accordingly, an image is recorded onto the sheet P.

At the maintenance position, the ink jet heads 32C, 32M, 32Y, and 32K face the maintenance unit 50. The maintenance unit 50 stores a moisturizing liquid, and comprises caps 52C, 52M, 52Y, and 52K. (an example of a moisturization cap) that cover the nozzle surfaces 202 of the ink jet heads 32C, 32M, 32Y, and 32K respectively. Configurations of the caps 52C, 52M, 52Y, and 52K are the same.

In a case where the ink jet heads 32C, 32M, 32Y, and 32K are positioned at the maintenance position, the ink jet heads are positioned above the caps 52C, 52M, 52Y, and 52K in the Z-direction respectively. At the maintenance position, a maintenance operation of the ink jet heads 32C, 32M, 32Y, and 32K is performed by a maintenance controller 156 (refer to FIG. 12). Examples of the maintenance operation include pre-jetting of driving a piezoelectric element provided for each of nozzles 214 (refer to FIG. 6) and jetting an ink that does not contribute to recording from the plurality of nozzles 214 and pressurization purging of pressurizing the inside of the head 32 and discharging the ink from the plurality of nozzles 214.

The caps 52C, 52M, 52Y, and 52K each comprise a suction mechanism (not illustrated) for sucking the nozzles 214 and a moisturizing liquid supplying mechanism (not illustrated) for supplying a moisturizing liquid to the caps 52C, 52M, 52Y, and 52K. In addition, a waste liquid tray 54 is disposed below the caps 52C, 52M, 52Y, and 52K in the Z-direction. A moisturizing liquid supplied to the cap 52 is discarded to the waste liquid tray 54, and is collected to a waste liquid tank 58 from the waste liquid tray 54 via waste liquid collecting piping 56.

In a case where the device is stopped for a long period of time, the head unit 30 is moved to the maintenance position, the nozzle surfaces 202 (refer to FIG. 6) of the ink jet heads 32C, 32111, 32Y, and 32K are covered with the caps 52C, 52M, 52Y, and 52K respectively, and a moisturization space is formed between the nozzle surfaces 202 and the caps 52C, 52M, 52Y, and 52K. Accordingly, non-jetting caused by dryness is prevented.

The nozzle surface cleaning unit 80 is provided between the image recording position and the maintenance position on a moving route of the head unit 30. The nozzle surface cleaning unit 80 comprises a nozzle surface wiping unit 82 and a nozzle surface wiping unit 86, each of which wipes the nozzle surfaces 202 of the ink jet heads 32C, 32M, 32Y, and 32K.

The nozzle surface wiping unit 82 and the nozzle surface wiping unit 86 are disposed so as to be arranged in a moving direction of each of the ink jet heads 32C, 32M, 32Y, and 32K (the X-direction). The nozzle surface wiping unit 82 may be disposed on a maintenance position side, and the nozzle surface wiping unit 86 may be disposed on an image recording position side. In a case where the ink jet heads 32C, 32M, 32Y, and 32K move (an example of relative movement) between the image recording position and the maintenance position, the nozzle surface wiping unit 82 and the nozzle surface wiping unit 86 wipe each of the nozzle surfaces 202.

The nozzle surface wiping unit 82 (an example of a first cleaning unit) comprises nozzle surface wiping devices 100C, 100M, 100Y, and 100K that individually wipe the nozzle surfaces 202 of the ink jet heads 32C, 32M, 32Y, and 32K included in the head unit 30. Each of the nozzle surface wiping devices 100C, 100M, 100Y, and 100K is provided on a common stand 84 in accordance with provision intervals between the ink jet heads 32C, 32M, 32Y, and 32K.

In addition, the nozzle surface wiping unit 86 (an example of a second cleaning unit) comprises nozzle surface wiping devices 140C, 140M, 140Y, and 140K that individually wipe the nozzle surfaces 202 of the ink jet heads 32C, 32M, 32Y, and 32K included in the head unit 30. Each of the nozzle surface wiping devices 140C, 140M, 140Y, and 140K is provided on a common stand 88 in accordance with the provision intervals between the ink jet heads 32C, 32M, 32Y, and 32K.

The nozzle surface wiping unit 82 and the nozzle surface wiping unit 86 are configured to be movable in the Z-direction. That is, the nozzle surface wiping unit 82 is configured to be movable between a wiping position where each of the nozzle surfaces 202 is wiped and a retracted position where each of the nozzle surfaces 202 is not wiped in a case where the ink jet heads 32C, 32M, 324; and 32K are moved to a position facing the nozzle surface wiping unit 82 by a moving mechanism (not illustrated). Similarly, the nozzle surface wiping unit 86 is configured to be movable between a wiping position where each of the nozzle surfaces 202 is wiped and a retracted position where each of the nozzle surfaces 202 is not wiped in a case where the ink jet heads 32C, 32M, 324; and 32K are moved to a position facing the nozzle surface wiping unit 86 by a moving mechanism (not illustrated).

[Structure of Ink Jet Head]

Since structures of the ink jet heads 32C, 32M, 32Y and 32K are the same, the ink jet heads will be described as the heads 32 in the following except for a case of particularly differentiating between the ink jet heads.

[Entire Structure]

Figure 4:
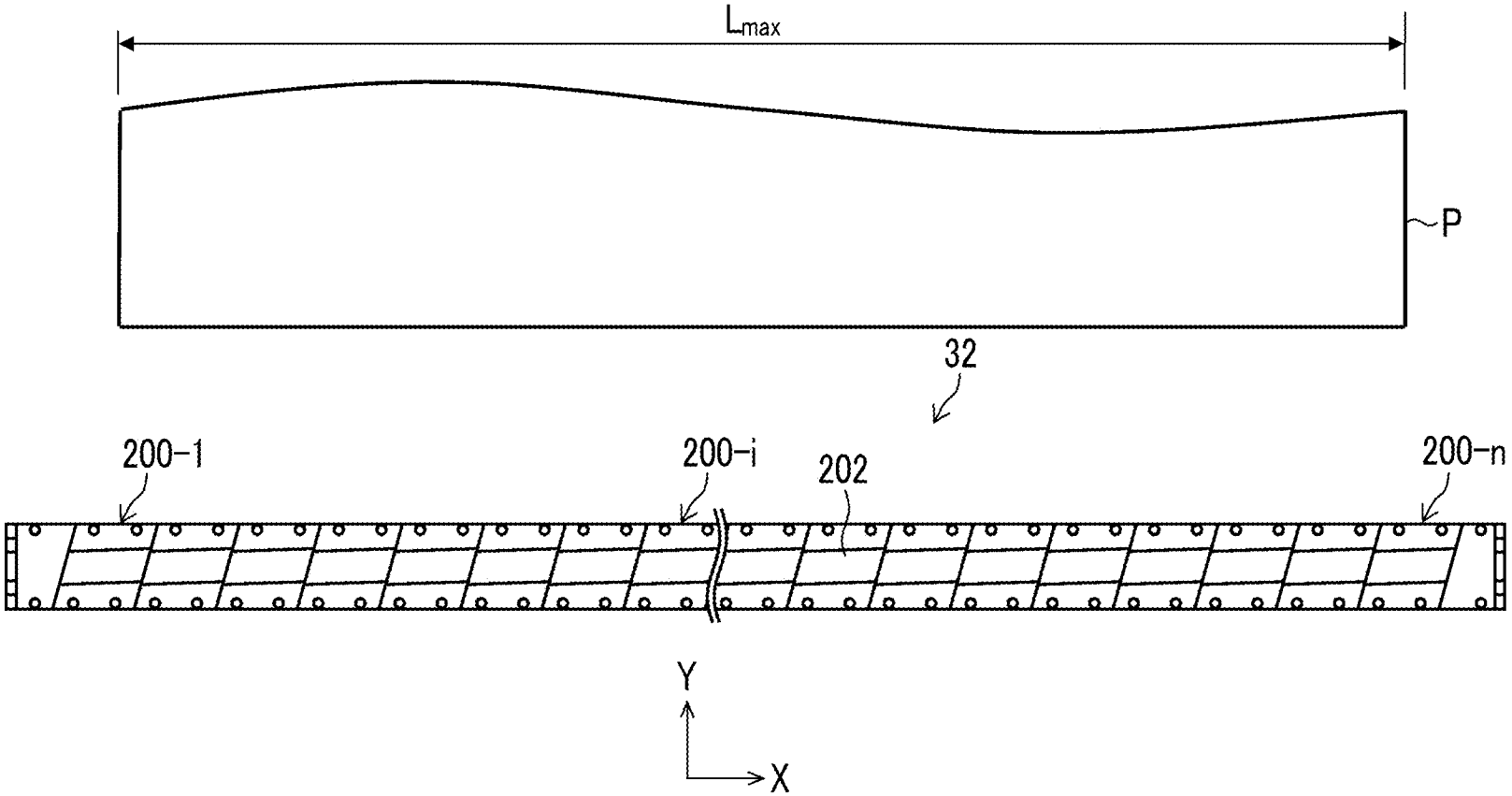
FIG. 4 is a configuration view of a head.

FIG. 4 is a configuration view of the head 32. The head 32 has a structure where head modules 200-1 to **200-*i* and to 200-*n* are joined together in a width direction (the X-direction) of the sheet P orthogonal to the transporting direction (the Y-direction) of the sheet P. Since configurations of the head modules 200-1 to 200-*i* and to 200-*n* are the same, the head modules will be described as the head modules 200** in the following except for a case of particularly differentiating between the head modules.

The plurality of nozzles 214 (refer to FIG. 6) are disposed on each of the nozzle surfaces 202 of the head module 200. That is, the head 32 is a full line type ink jet head in which the plurality of nozzles 214 are disposed over a length corresponding to a full width $L_{max}$ of the sheet P.

[Example of Structure of Head Module]

Figure 5:
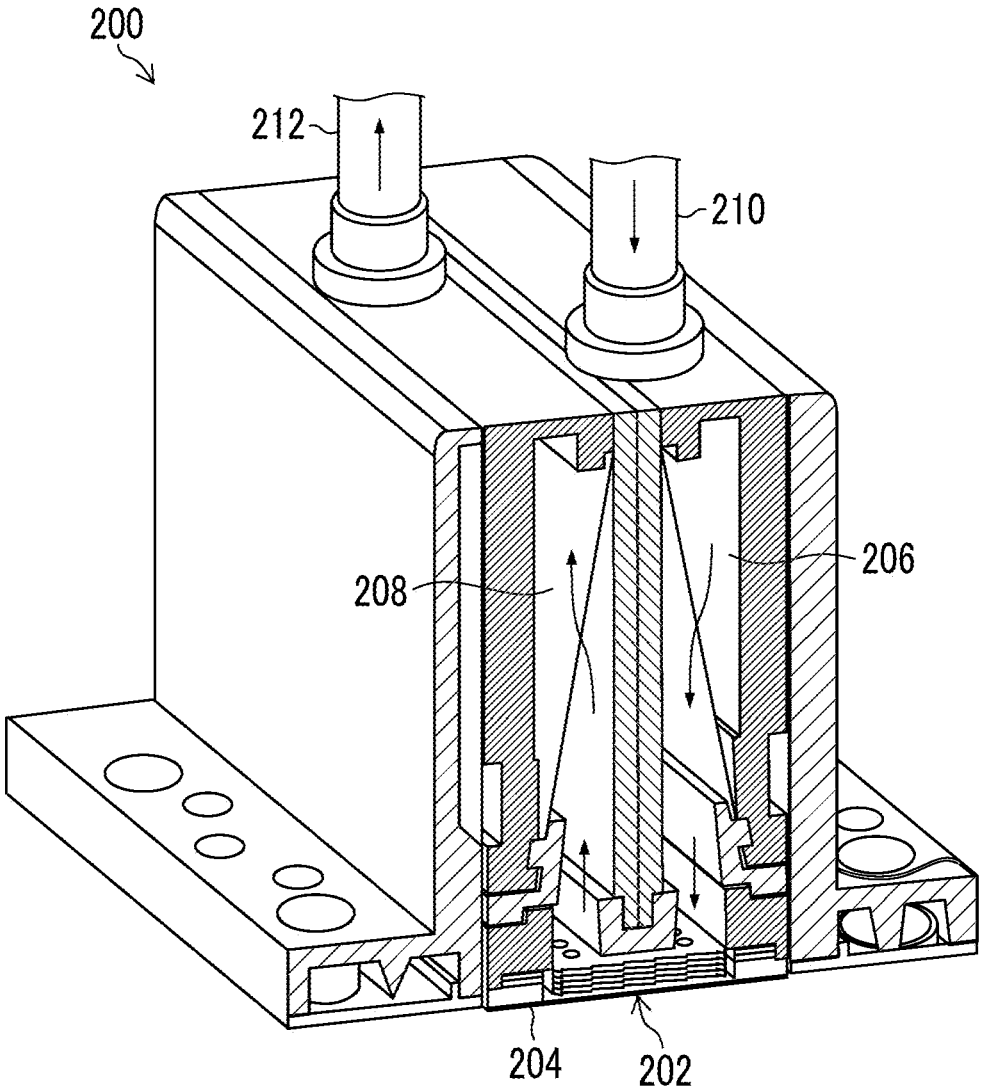
FIG. 5 is a perspective view of a head module.

FIG. 5 is a perspective view of the head module 200 and is a view including a cross-sectional view of a part thereof. As illustrated in FIG. 5, the head module 200 has an ink supplying unit formed by an ink supplying chamber 206 and an ink circulating chamber 208 on an opposite side (the upper side in FIG. 5) of the nozzle surface 202 of a nozzle plate 204.

An ink is supplied from the ink circulating unit 300 (refer to FIG. 8) to the ink supplying chamber 206 via a supply pipe line 210. In addition, the ink circulating chamber 208 causes an ink to be collected to the ink circulating unit 300 via a circulation pipe line 212. Details of the supply pipe line 210 will be described below.

Figure 6:
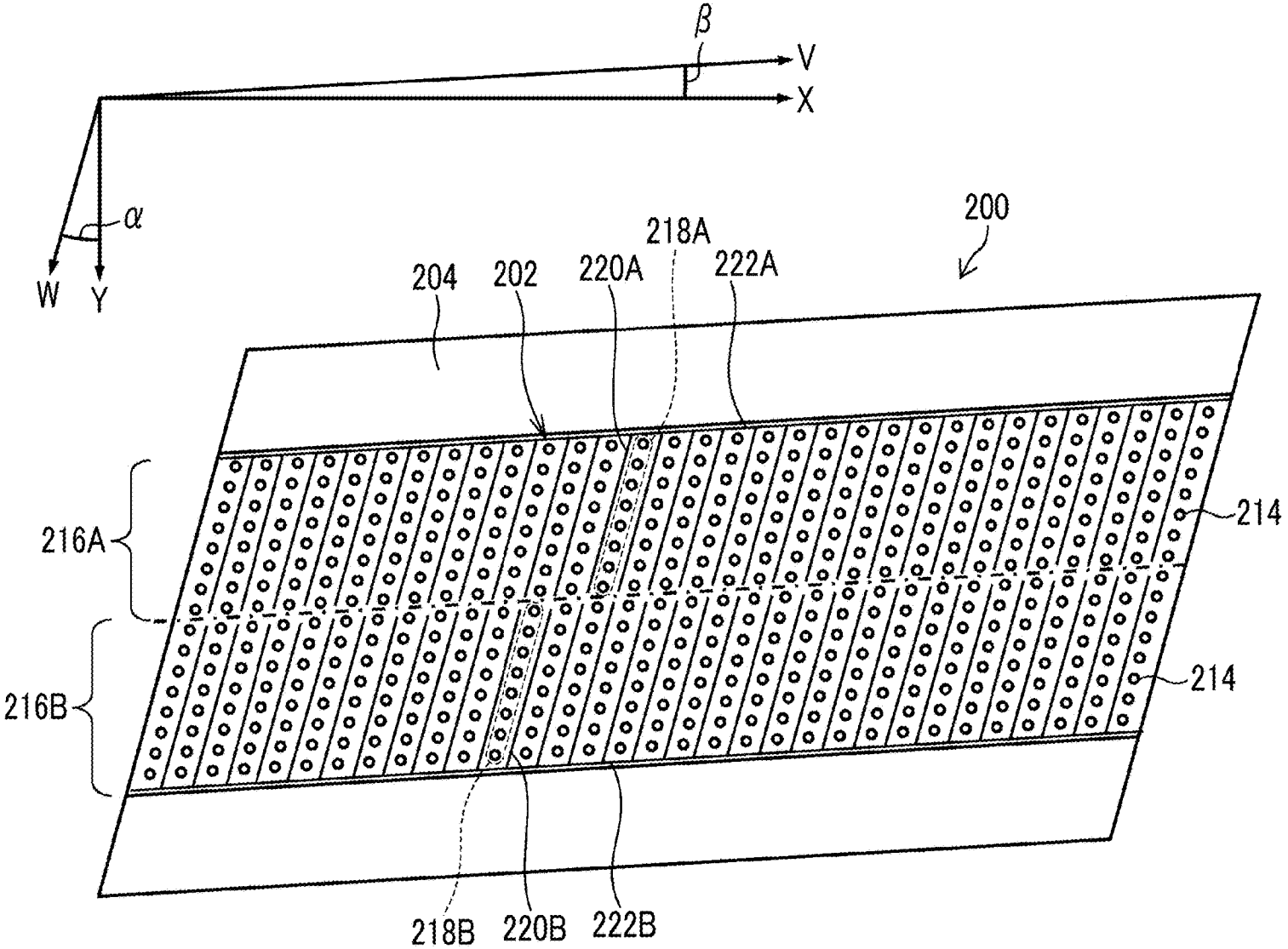
FIG. 6 is a planar perspective view of a nozzle surface of the head module.

FIG. 6 is a planar perspective view of the nozzle surface 202 of the head module 200. The head module 200 has a parallelogrammic planar shape having long-side end surfaces along a V-direction, each of which has an inclination of an angle β respect to the X-direction, and short-side end surfaces along a W-direction, each of which has an inclination of an angle a with respect to the Y-direction, and the plurality of nozzles 214 are disposed in a row direction which follows the V-direction and a column direction which follows the W-direction. FIG. 6 illustrates the nozzles 214 with the number thereof omitted.

The head module 200 has a structure capable of being divided into a first block 216A and a second block 216B that are two blocks, in which flow passages communicating with the nozzles 214 in the W-direction are independent of each other.

The first block 216A is provided with a supply flow passage 220A for each nozzle line 218A configured by the plurality of nozzles 214 disposed along the W-direction. The plurality of supply flow passages 220A communicate with a main flow passage 222A provided along the V-direction.

Similarly, the second block 216B is provided with a supply flow passage 220B for each nozzle line 218B configured by the plurality of nozzles 214 disposed along the W-direction, and the plurality of supply flow passages 220B communicate with a main flow passage 222B provided along the V-direction.

Therefore, an ink is supplied to each of the nozzles 214 that belong to the same nozzle line 218A from the same supply flow passage 220A, and an ink is supplied to each of the nozzles 214 that belong to the same nozzle line 218B from the same supply flow passage 220B. Herein, the number of the nozzles 214 that belong to the first block 216A and the number of the nozzles 214 that belong to the second block 216B are the same, and the nozzles that belong to the first block and the nozzles that belong to the second block are disposed to be symmetrical to each other with respect to a straight line along the V-direction, which divides the head module 200 into equal parts.

Without the disposition of the nozzles and the supply flow passages being limited to the form illustrated in FIG. 6, a nozzle line can be configured as appropriate.

Figure 7:
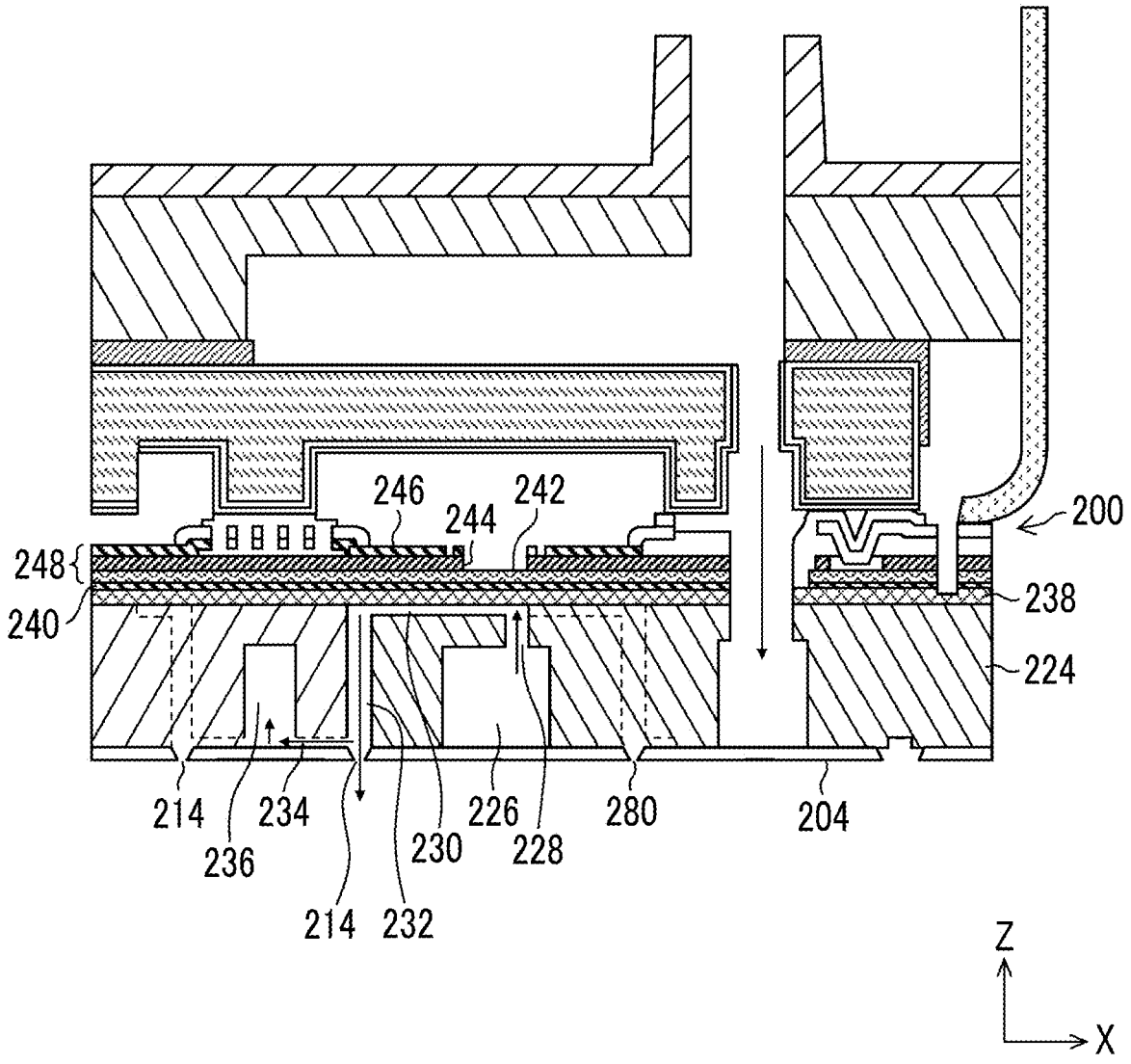
FIG. 7 is a cross-sectional view illustrating an internal structure of the head module.

FIG. 7 is a cross-sectional view illustrating an internal structure of the head module 200. The head module 200 comprises a flow passage structure 224. The flow passage structure 224 is provided with a common supply flow passage 726, an individual supply passage 228, a pressure chamber 230, a nozzle communication passage 232, an individual circulation flow passage 234, and a common circulation flow passage 236.

A diaphragm 238 is provided above the flow passage structure 224 in FIG. 7. A piezoelectric element 248, which is formed by a lamination structure including a lower electrode (common electrode) 242, a piezoelectric layer 244, and an upper electrode (individual electrode) 246, is provided above the diaphragm 238 in FIG. 7 via a bonded layer 240. The piezoelectric element 248 is provided for each pressure chamber 230. The upper electrode 246 is an individual electrode that is patterned so as to correspond to a shape of the pressure chamber 230.

The common supply flow passage 226 is connected to the ink supplying chamber 206 (refer to FIG. 5). An ink is supplied from the ink supplying chamber 206 to the pressure chamber 230 via the common supply flow passage 226. A recording controller 152 (refer to FIG. 12) applies a drive voltage to the upper electrode 246 of the piezoelectric element 248 provided in the corresponding pressure chamber 230 according to an image signal of an image to be recorded. Accordingly, the piezoelectric element 248 and the diaphragm 238 change, thereby changing a volume of the pressure chamber 230. Due to a pressure change following the volume change, an ink is jetted from the nozzle 214 via the nozzle communication passage 232.

In addition, the sheet (refer to FIG. 2) is transported in the Y-direction at a constant speed by the sheet transporting unit 20. A desired image is recorded onto the sheet P as the recording controller 152 controls a time point at which an ink is jetted from each of the nozzles 214 in accordance with a transported speed of the sheet P.

The pressure chamber 230 provided so as to correspond to each of the nozzles 214 has a substantially square planar shape, an outlet to the nozzle 214 is provided on one of both corners on a diagonal line, and the individual supply passage 228 is provided on the other of both corners.

A shape of the pressure chamber is not limited to a square. Examples of the planar shape of the pressure chamber include a quadrangle (such as a rhombus and a rectangle), a pentagon, a hexagon, and other polygonal shapes as well as various forms such as a circle and an ellipse.

The common circulation flow passage 236 is connected to the ink circulating chamber 208 (refer to FIG. 5). An ink is collected to the common circulation flow passage 236 (an example of a circulation flow passage) at all times through the individual circulation flow passage 234. Accordingly, the thickening of an ink in a nozzle unit at the time of non-jetting (non-driving) is prevented.

Although a system in which the piezoelectric element is used as a jet system of the ink jet head is given as an example herein, a thermal system in which an ink is jetted by causing a film boiling phenomenon with the use of a heating element disposed in a liquid chamber may be applied.

<Ink Circulating Unit>

The ink jet heads 32C, 32M, 32Y, and 32K. comprise the ink circulating units 300 for respective inks, which supply and collect a cyan ink, a magenta ink, a yellow ink, and a black ink into and from the ink jet heads 32C, 32M, 32Y, and 32K respectively.

Figure 8:
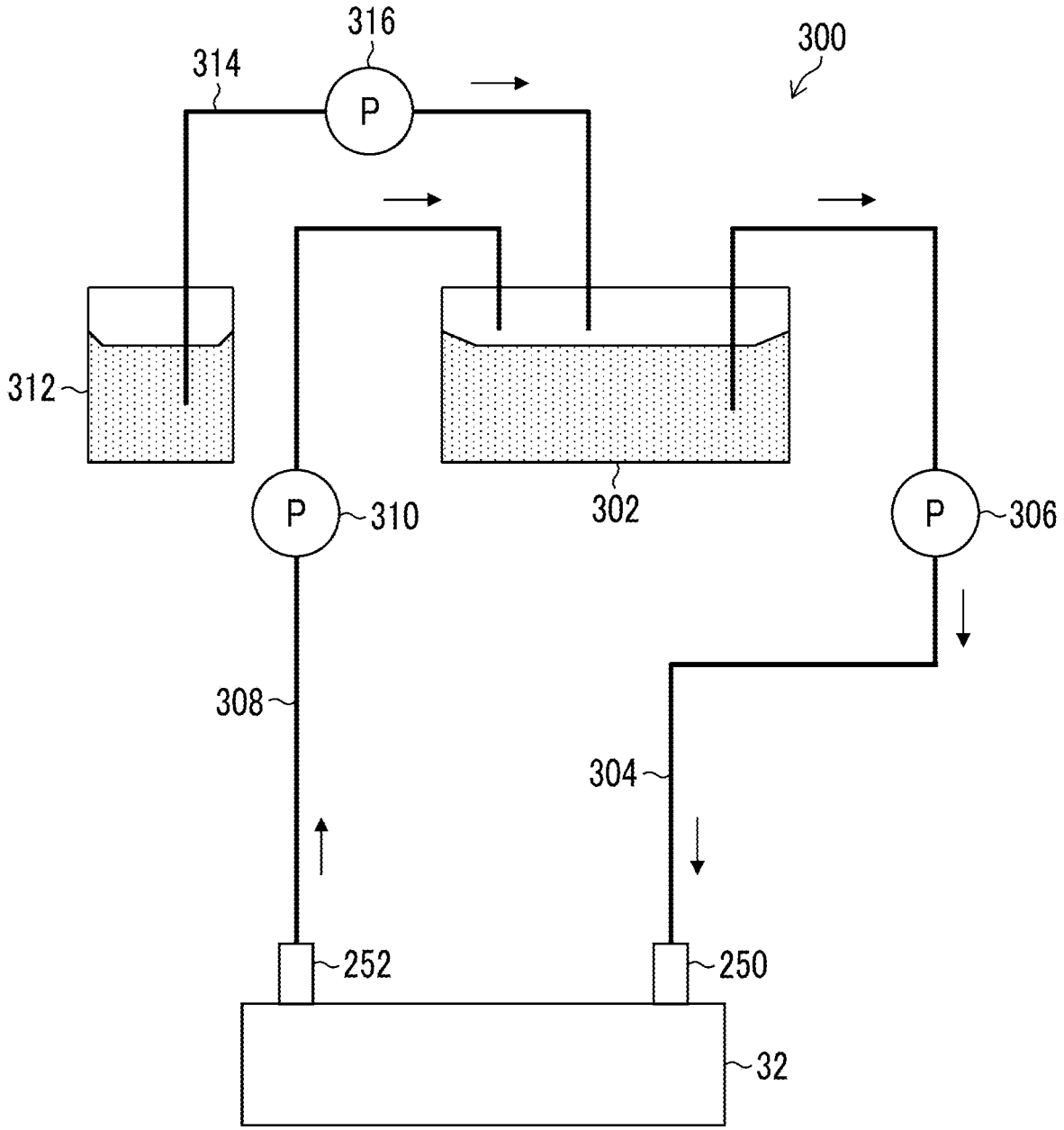
FIG. 8 is a schematic view of an ink circulating unit.

FIG. 8 is a schematic view of the ink circulating unit 300. The ink circulating unit 300 comprises a circulation tank 302, an ink supply flow passage 304, a supply pump 306, an ink collection flow passage 308, a collection pump 310, a replenishment tank 312, an ink replenishment flow passage 314, and a replenishment pump 316.

The circulation tank 302 (an example of a liquid tank) stores each color of ink (an example of a liquid) to be used by each head 32. Herein, a water-based ink that contains latex is used.

The water-based ink is an ink of which a main component of solvent is water, and for example, is an ink in which 50% by mass or more of solvent is water. The water-based ink may contain water-soluble organic solvent. In addition, latex is a material, in which a fine polymer component that is insoluble in water is dispersed in an aqueous medium. Although an ink is likely to become dry and solidify in a case of containing latex, the maintenance of the liquid jetting head can be performed appropriately in the embodiment even in case where an ink that contains latex is used.

The ink supply flow passage 304 communicates with the circulation tank 302 and a supply port 250 of the head 32. The supply port 250 communicates with the supply pipe line 210 (refer to FIG. 5) of each head module 200. The supply pump 306 is liquid sending means provided in the ink supply flow passage 304, and sends an ink stored in the circulation tank 302 to the head 32.

In addition, the ink collection flow passage 308 communicates with a discharge port 252 of the head 32 and the circulation tank 302. The discharge port 252 communicates with the circulation pipe line 212 of each head module 200. The collection pump 310 is liquid sending means provided in the ink collection flow passage 308, and sends an ink inside the head 32 to the circulation tank 302.

The replenishment tank 312 stores an ink having the same color as the ink stored in the circulation tank 302. The ink replenishment flow passage 314 communicates with the replenishment tank 312 and the circulation tank 302. The replenishment pump 316 is liquid sending means provided in the ink replenishment flow passage 314, and sends an ink stored in the replenishment tank 312 to the circulation tank 302.

The ink circulating unit 300 configured in such a manner causes the supply pump 306 to send the ink stored in the circulation tank 302 to the head 32, and causes the collection pump 310 to send an ink that is not jetted from the nozzles 214 (refer to FIG. 6), out of an ink sent to the head 32, to the circulation tank 302.

In addition, the replenishment pump 316 sends an ink from the replenishment tank 312 to the circulation tank 302 by the amount that is decreased from the inside of the circulation tank 302 due to the jetting of an ink from the nozzles 214.

Since an ink inside the head 32 is kept at a fresh state at all times by the ink circulating inside the head 32 in such a manner, fixing of the ink inside the head 32 can be prevented.

<Cleaning Device>

[Nozzle Surface Wiping Device Using Napped Wiping Member]

Since configurations of the nozzle surface wiping devices 100C, 100M, 100Y, and 100K are the same, the nozzle surface wiping devices will be described as the nozzle surface wiping device 100 in the following except for a case of particularly differentiating between the nozzle surface wiping devices.

Figure 9:
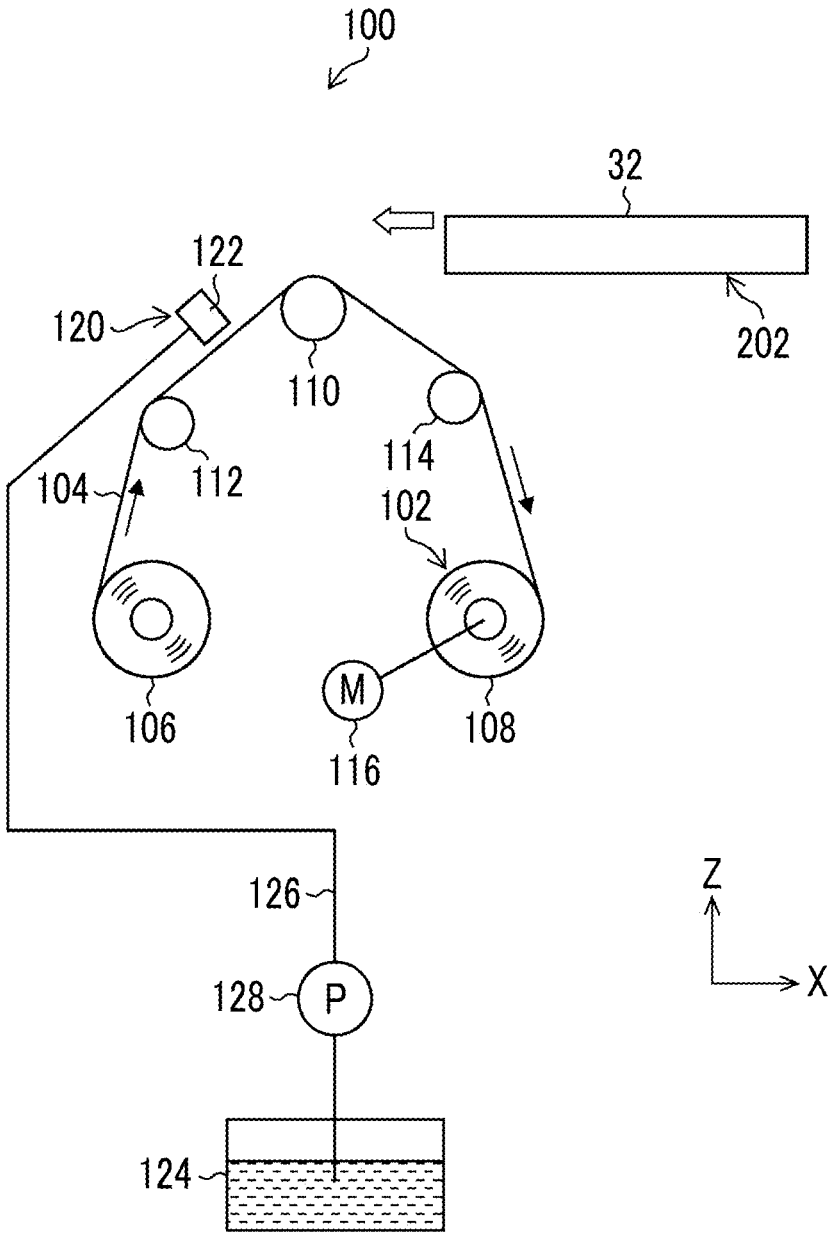
FIG. 9 is a schematic view of a nozzle surface wiping device.

FIG. 9 is a schematic view illustrating a schematic configuration of the nozzle surface wiping device 100. As illustrated in FIG. 9, the nozzle surface wiping device 100 comprises a web transporting unit 102 that transports a napped wiping web 104 in a first direction at a first speed and a cleaning liquid applying unit 120 that supplies a cleaning liquid to the napped wiping web 104.

The web transporting unit 102 comprises a supply shaft 106 that sends out the napped wiping web 104, a winding shaft 108 that winds the napped wiping web 104, a press roller 110 that presses the napped wiping web 104 so as to abut against the nozzle surface 202 of the head 32, a first guide roller 112 that guides the running of the napped wiping web 104 between the supply shaft 106 and the press roller 110, a second guide roller 114 that guides the running of the napped wiping web 104 between the press roller 110 and the winding shaft 108, and a winding motor 116 that rotation-drives the winding shaft 108.

Figure 10:
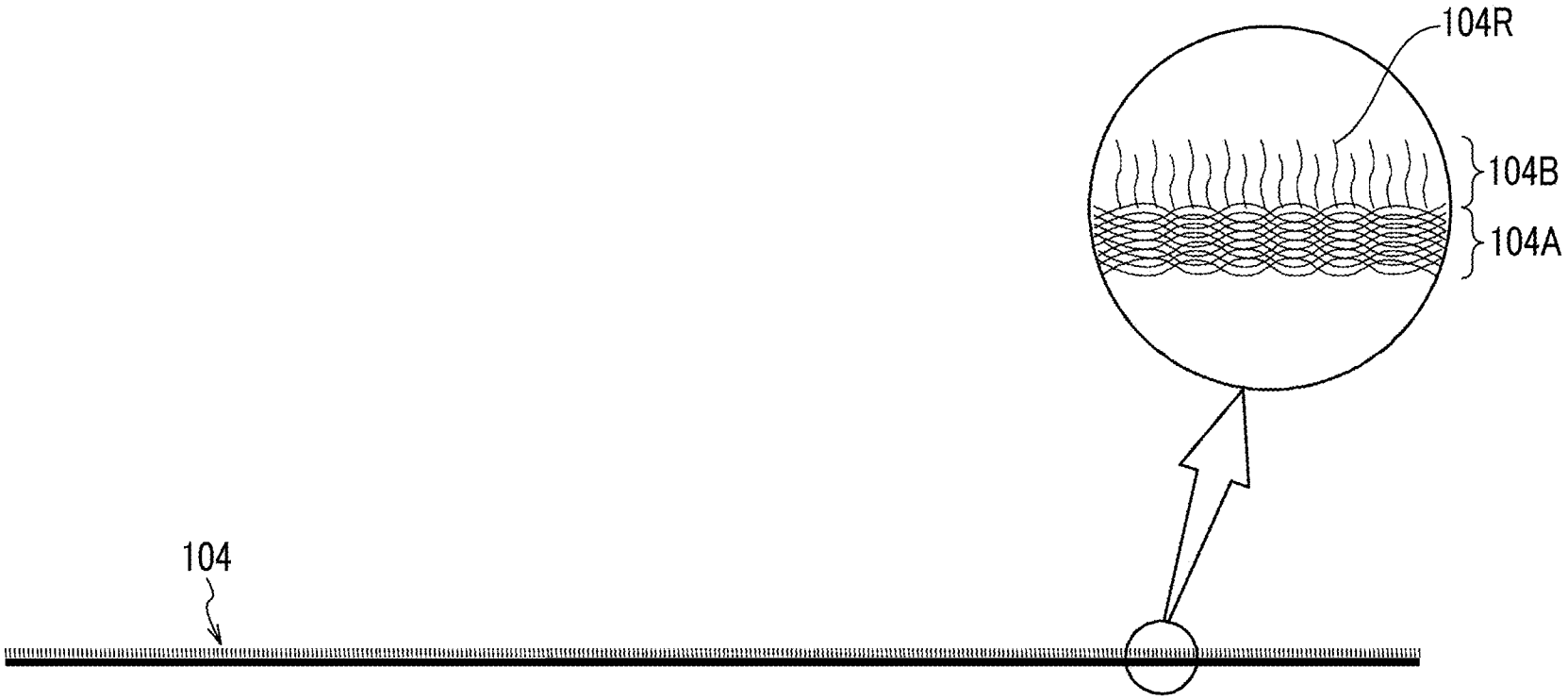
FIG. 10 is a side view of a napped wiping web.

FIG. 10 is a side view of the napped wiping web 104. The napped wiping web 104 (an example of a napped wiping member) is configured by a long sheet-like material of which a wiping surface that wipes the nozzle surface 202 of the head 32 is napped. Specifically, the napped wiping web is configured by a ground weave part (base material) 104A formed of knit or textile in which microfiber, such as polyethylene terephthalate, polyethylene, and acryl, is used and a napped part 104B formed of extremely fine napped yarn 1048, such as polyethylene terephthalate, polyethylene, and acryl that are woven or knitted into the ground weave part 104A. That is, the napped wiping web 104 is configured by cloth of which a surface is made fluffy (so-called napped cloth).

Referring back to FIG. 9, a width of the napped wiping web 104 corresponds to a width of the head 32, which is a wiping target, in a direction orthogonal to a moving direction thereof, that is, a width of the head 32 in Y-direction, and is the same width or substantially the same width as the width of the head.

The supply shaft 106 is rotatably supported by a shaft (not illustrated). The supply shaft 106 is disposed to be orthogonal to the moving direction of the head 32, and is disposed horizontally. A reel (not illustrated) is attachably and detachably mounted on the supply shaft 106. The napped wiping web 104 is wound around the reel in a roll shape, and is mounted on the supply shaft 106.

The napped wiping web 104 mounted on the supply shaft 106 is in a dry state (cleaning liquid non-applied state) where a cleaning liquid is not applied.

The winding shaft 108 is rotatably supported by a shaft (not illustrated). The winding shaft 108 is disposed to be orthogonal to the moving direction of the head 32, and is disposed horizontally. A reel (not illustrated) is attachably and detachably mounted on the winding shaft 108. The napped wiping web 104 is wound around the reel mounted on the winding shaft 108 in a roll shape.

The press roller 110 (an example of an abutting member) has a roller shape (cylindrical shape). A length of the press roller 110 in a direction (axial direction) orthogonal to a radial direction thereof is a length corresponding to the width of the napped wiping web 104, and a size thereof in the radial direction can be determined as appropriate. The press roller 110 is supported to be rotatable and movable up and down in a state of being biased upward in the Z-direction.

The press roller 110 is disposed to be orthogonal to the moving direction of the head 32, and is disposed horizontally. The napped wiping web 104 is wound around an upper circumferential surface of the press roller 110, and is pressed and abutted against the nozzle surface 202 of the head 32 via the press roller 110.

The first guide roller 112 is rotatably supported by a horizontal shaft (not illustrated), and is disposed between the supply shaft 106 and the press roller 110 so as to be orthogonal to the moving direction of the head 32. The first guide roller 112 guides the napped wiping web 104 sent out from the supply shaft 106 to the press roller 110.

The second guide roller 114 is rotatably supported by a horizontal shaft (not illustrated), and is disposed between the press roller 110 and the winding shaft 108 so as to be orthogonal to the moving direction of the head 32. The second guide roller 114 guides the napped wiping web 104, which has wiped the nozzle surface 202 by means of the press roller 110, to the winding shaft 108.

The winding motor 116 has a rotary shaft (not illustrated) connected to the winding shaft 108, and rotation-drives the winding shaft 108 by rotating the rotary shaft. As the winding shaft 108 rotates to the left in FIG. 9, the napped wiping web 104 is transported from the supply shaft 106 to the winding shaft 108, and the winding shaft 108 is wound.

The cleaning liquid applying unit 120 is configured to comprise a cleaning liquid supplying nozzle 122, a cleaning liquid tank 124 that stores a cleaning liquid, a cleaning liquid flow passage 126 that connects the cleaning liquid supplying nozzle 122 to the cleaning liquid tank 124, and a cleaning liquid pump 128 that sends a cleaning liquid from the cleaning liquid tank 124 to the cleaning liquid supplying nozzle 122.

By driving the cleaning liquid pump 128, the cleaning liquid applying unit 120 supplies a cleaning liquid from the cleaning liquid tank 124 to the cleaning liquid supplying nozzle 122 via the cleaning liquid flow passage 126.

The cleaning liquid supplying nozzle 122 has a spouting port having a width corresponding to the width of the napped wiping web 104, and spouts the cleaning liquid, which is supplied from the cleaning liquid tank 124, from the spouting port to the napped wiping web 104. In a case where the napped wiping web 104 passes a position facing the cleaning liquid supplying nozzle 122, the cleaning liquid spouted from the spouting port is applied to the napped wiping web. Accordingly, the cleaning liquid is absorbed into the napped wiping web 104, and the napped wiping web 104 comes into a wet state (cleaning liquid applied state).

A transported speed of the napped wiping web 104 by the web transporting unit 102 and an applied amount of a cleaning liquid supplied by the cleaning liquid applying unit 120 are determined by a cleaning liquid permeation speed of the napped wiping web 104. That is, it is necessary to set time it takes for the napped wiping web 104 to be transported from the position facing the cleaning liquid supplying nozzle 122 to a position of the press roller 110 longer than time it takes for the cleaning liquid supplied to the napped wiping web 104 to permeate the napped wiping web 104.

[Nozzle Surface Wiping Device Using Unnapped Wiping Member]

Since configurations of the respective nozzle surface wiping devices 140C, 140M, 140Y, and 140K are the same, the nozzle surface wiping devices will be described as the nozzle surface wiping device 140 in the following except for a case of particularly differentiating between the nozzle surface wiping devices.

Figure 11:
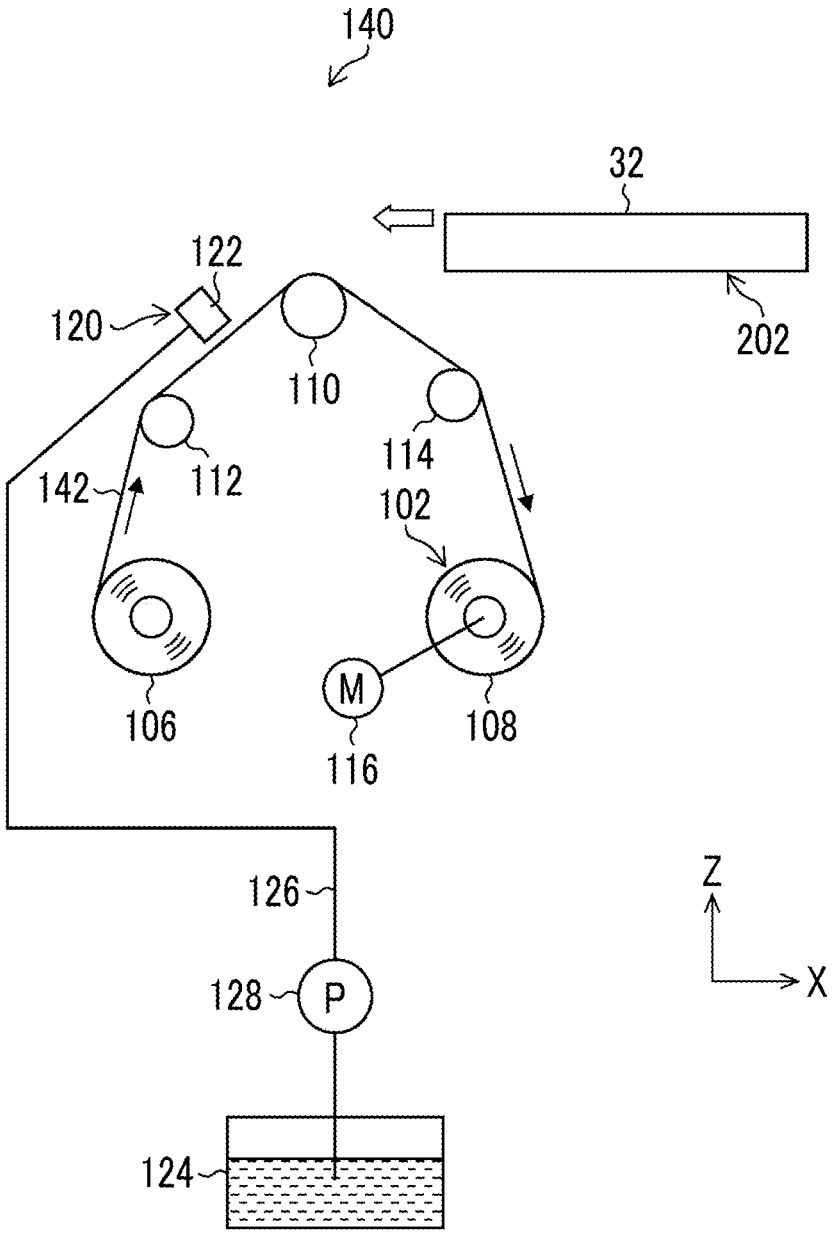
FIG. 11 is a schematic view of the nozzle surface wiping device.

FIG. 11 is a schematic view illustrating a schematic configuration of the nozzle surface wiping device 140. Portions common to the nozzle surface wiping device 100 illustrated in FIG. 9 will be assigned with the same reference signs, and detailed description thereof will be omitted.

As illustrated in FIG. 11, the nozzle surface wiping device 140 is different from the nozzle surface wiping device 100 in that the nozzle surface wiping device 140 comprises an unnapped wiping web 142 instead of the napped wiping web 104.

The unnapped wiping web 142 (an example of an unnapped wiping member) is a sheet-like wiping member in which, for example, the ground weave part 104A illustrated in FIG. 10 is disposed on a wiping surface that wipes the nozzle surfaces 202 of the head 32.

<Control System of Ink Jet Recording Device>

Figure 12:
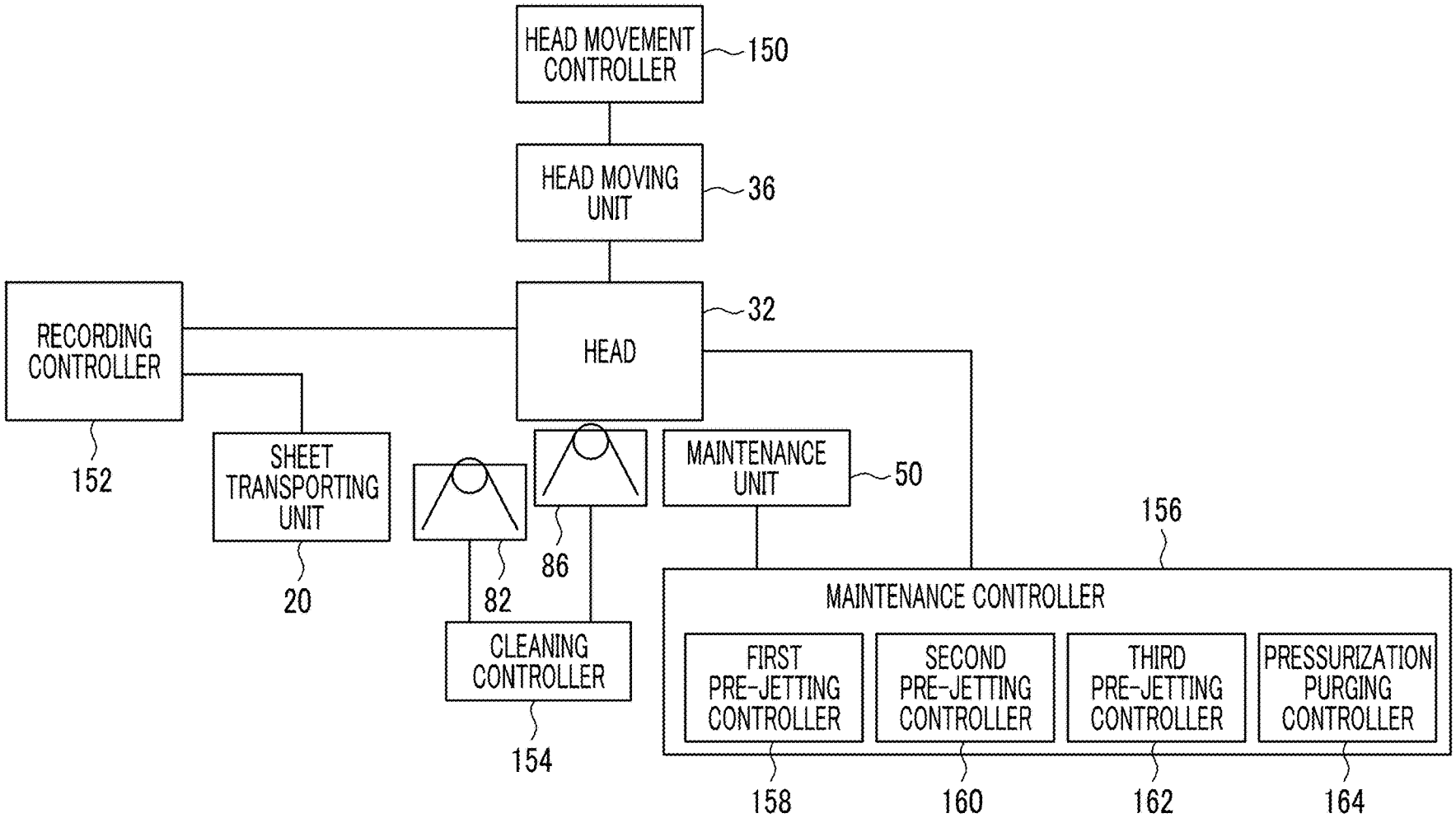
FIG. 12 is a block diagram showing a control system of the ink jet recording device.

FIG. 12 is a block diagram showing a control system of the ink jet recording device 10. The ink jet recording device 10 comprises a head movement controller 150, the recording controller 152, the cleaning controller 154, and the maintenance controller 156.

The head movement controller 150 controls the head moving unit 36, and moves the head 32 included in the head unit 30 between the "image recording position" and the "maintenance position".

The recording controller 152 controls the sheet transporting unit 20 and the piezoelectric element 248 (refer to FIG. 7) for each of the nozzles 214 of the head 32 positioned at the image recording position based on image data to be recorded onto the sheet P to transport the sheet P and to jet ink droplets of each color, and records an image on a recording surface of the sheet P.

The cleaning controller 154 controls the nozzle surface wiping unit 82 and the nozzle surface wiping unit 86 to wipe the nozzle surface 202 (refer to FIG. 6) of the head 32.

The maintenance controller 156 comprises a first pre-jetting controller 158, a second pre-jetting controller 160, a third pre-jetting controller 162, and a pressurization purging controller 164.

The first pre-jetting controller 158, the second pre-jetting controller 160, and the third pre-jetting controller 162 control the piezoelectric element 248 for each of the nozzles 214 of each head 32 to pre-jet an ink from the nozzles 214 of the head 32. In a case where the nozzles 214 can jet ink droplets having a plurality of sizes, ink droplets having the largest size are pre-jetted.

In addition, the pressurization purging controller 164 causes a pressurizing unit (not illustrated) to pressurize the inside of the head 32, and causes an ink to be discharged from the nozzles 214 of the head 32.

<Liquid Jetting Head Cleaning Method>

Figure 13:
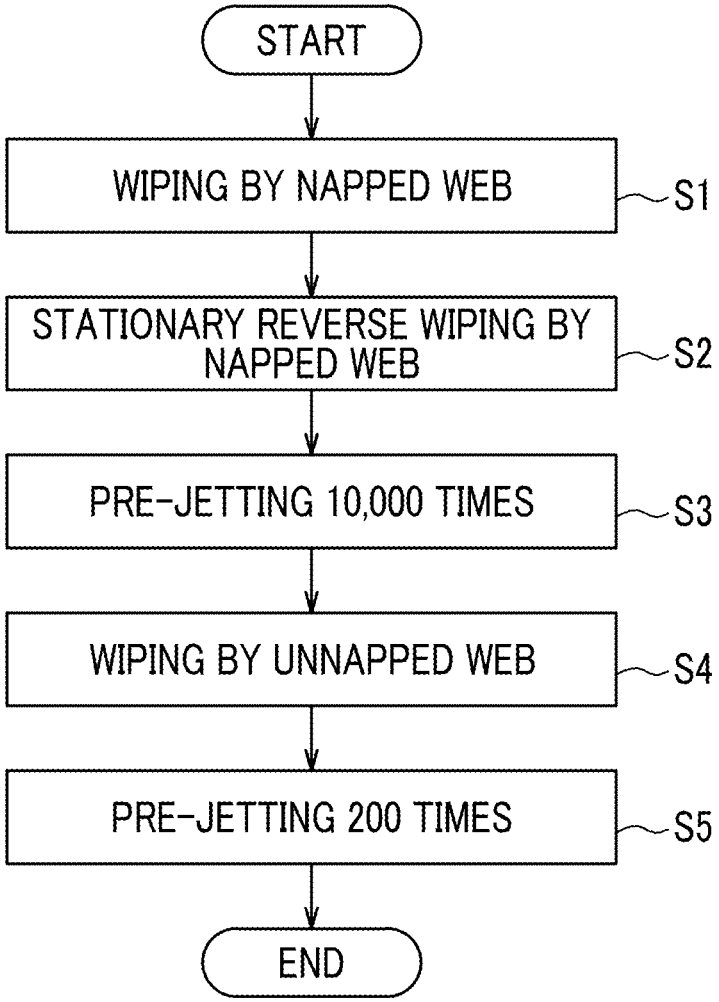
FIG. 13 is a flowchart showing processing of a head cleaning method.

FIG. 13 is a flowchart showing processing of a cleaning method of the head 32 by the ink jet recording device 10 (an example of a liquid jetting head cleaning device).

Herein, cleaning after the head 32 has performed pre-jetting at the maintenance position will be described. The pre-jetting is controlled by the third pre-jetting controller 162. of the maintenance controller 156. The pre-jetting is performed in order to remove an ink of which viscosity inside the nozzles 214 has risen and an ink fixed to the vicinity of the nozzles 214. The pre-jetting herein means jetting an ink 10,000 times per nozzle.

In a case where pre-jetting is finished, the nozzle surface wiping unit 82 wipes the nozzle surfaces 202 of the head 32 in Step S1 (an example of a first cleaning step).

That is, the cleaning controller 154 moves the nozzle surface wiping unit 82 to the wiping position and moves the nozzle surface wiping unit 86 to the retracted position. In addition, the cleaning controller 154 causes the web transporting unit 102 of each of the nozzle surface wiping devices 100C, 100M, 100Y, and 100K of the nozzle surface wiping unit 82 to transport the napped wiping web 104. In addition, the cleaning controller 154 causes the cleaning liquid applying unit 120 of each of the nozzle surface wiping devices 100C, 100M, 100Y, and 100K to supply a cleaning liquid to the napped wiping web 104.

In this state, the head movement controller 150 controls the head moving unit 36 to move the ink jet heads 32C, 32M, 32Y, and 32K from the maintenance position to the image recording position.

Accordingly, the napped wiping web 104 of each of the nozzle surface wiping devices 100C, 100M, 100Y, and 100K, to which a cleaning liquid is applied, is pressed and abutted against each of the nozzle surfaces 202 of the moving ink jet heads 32C, 32M, 32Y, and 32K via the press roller 110, thereby wiping and cleaning the nozzle surfaces 202.

Herein, the napped wiping web 104 has the napped yarn 104R. Therefore, the napped yarn 104R can enter the inside of the nozzles 214 in a case where the napped wiping web 104 wipes the nozzle surfaces 202, and dirt inside the nozzles 214 can be removed.

The head movement controller 150 may move the ink jet heads 32C, 32M, 32Y, and 32K to a position where the nozzle surface wiping unit 82 finishes wiping each of the nozzle surfaces 202 instead of moving to the image recording position.

Next, in Step S2, the nozzle surface wiping unit 82 performs stationary reverse wiping of each of the nozzle surfaces 202 of the ink jet heads 32C, 32M, 32Y, and 32K.

That is, the cleaning controller 154 continues to move the nozzle surface wiping unit 82 to the wiping position and to move the nozzle surface wiping unit 86 to the retracted position. In addition, the cleaning controller 154 causes the web transporting unit 102 to stop transporting the napped wiping web 104.

In addition, the head movement controller 150 controls the head moving unit 36 to move the ink jet heads 32C, 32M, 32Y, and 32K from the image recording position to the maintenance position.

Accordingly, the napped wiping web 104 which is stopped being transported can wipe the nozzle surfaces 202 in a reverse direction to Step S1.

In Step S3 (an example of after cleaning by the first cleaning unit), the first pre-jetting controller 158 of the maintenance controller 156 controls the ink jet heads 32C, 32M, 32Y, and 32K to pre-jet an ink 10,000 times per nozzle 214 toward the caps 52C, 52M, 52Y, and 52K (an example of a liquid receiving unit that receives a pre-jetted liquid) at the maintenance position (an example of a first pre-jetting control step).

The pre-jetting is executed in order to blow off and remove an ink adhered to the nozzles 214 and the napped yarn 104R that falls out from the napped wiping web 104 and is adhered to the nozzles 214. Since time it takes for an ink containing latex to be dried and solidified is short, it is preferable that the pre-jetting starts within 20 seconds from the wiping of Step S2.

Figure 14:
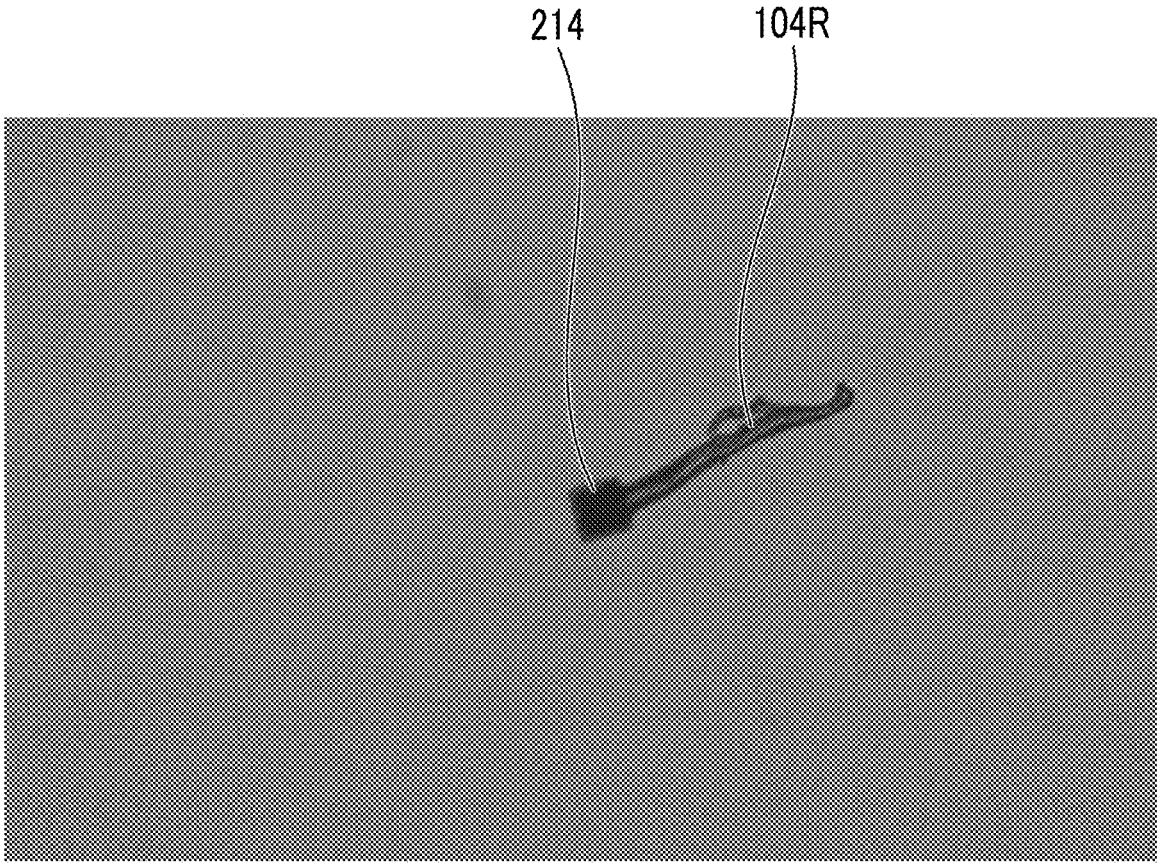
FIG. 14 is an image illustrating an example of a napped yarn that is fallen out and is adhered to a nozzle in a case of wiping.

FIG. 14 is an image illustrating an example of the nozzle 214 and the napped yarn 104R that is fallen out from the napped part 104B of the napped wiping web 104 in a case of wiping and is adhered to the nozzle 214. Herein, the nozzle 214 has a rectangular shape, and a length of one side thereof is 16.5 μm. In addition, the napped yarn 104R has a thickness of approximately 5 to 10 μm. Pre-jetting requires the number of times of jetting sufficient to blow off such an object adhered to the nozzle 214.

In addition, the ink jet heads 32C, 32M, 32Y, and 32K each have the plurality of nozzles 214 divided into a plurality of groups, and an ink is pre-jetted from the nozzles 214 at time points different for each group.

Figure 15:
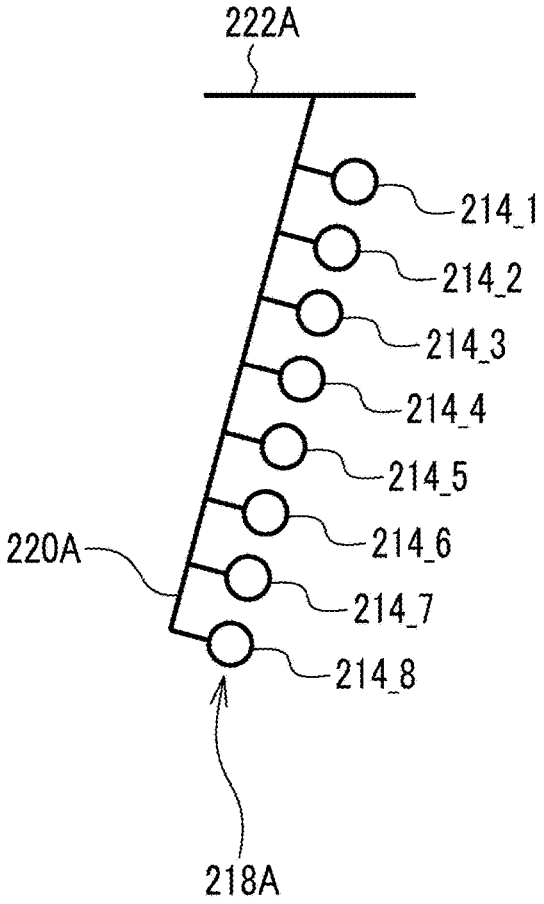
FIG. 15 is a schematic view of one nozzle line having eight nozzles.

FIG. 15 is a schematic view of one nozzle line 218A having nozzles 214_1 to 214_8. As described above, the supply flow passage 220A that communicates with the main flow passage 222A is provided for each nozzle line 218A. Herein, the nozzles 214 adjacent to each other, out of the plurality of nozzles 214_1 to 214_8 to which an ink is supplied from the same supply flow passage 220A, are divided into the plurality of groups so as to belong to groups different from each other.

For example, this condition can be satisfied by dividing the nozzles 214_1, 214_3, 214_5, and 214_7 into a first group, and dividing the nozzles 2142, 214_4, 214_6, and 214_8 into a second group. In addition, the nozzles 214_1 and 214_5 may be divided into the first group, the nozzles 214_2 and 214_6 may be divided into the second group, the nozzles 214_3 and 214_7 may be divided into a third group, and the nozzles 214_4 and 214_8 may be divided into a fourth group. The other nozzle lines 218A and the other nozzle lines 218B are also divided into groups similarly.

The first pre-jetting controller 158 causes an ink to be pre-jetted from the nozzles 214 at time points different for each group. That is, the first pre-jetting controller 158 causes an ink to be pre-jetted from the nozzles 214 in the first group 10,000 times per nozzle, and after then causes an ink to be pre-jetted from the nozzles 214 in the second group 10,000 times per nozzle. Similarly, also in a case where there are three or more groups, pre-jetting is performed in turn for each group. By pre-jetting in this manner, adherence of mist to the nozzle surfaces 202 can be suppressed. In a case of pre-jetting for each group, it is preferable that the last group pre-jets an ink within 20 seconds from the wiping of Step S2.

Next, in Step S4 (an example of after pre-jetting by the first pre-jetting controller), the nozzle surface wiping unit 86 wipes the nozzle surfaces 202 of the ink jet heads 32C, 32M, 32Y, and 32K (an example of a second cleaning step).

That is, the cleaning controller 154 moves the nozzle surface wiping unit 82 to the retracted position and moves the nozzle surface wiping unit 86 to the wiping position. In addition, the cleaning controller 154 causes the web transporting unit 102 of each of the nozzle surface wiping devices 140C, 140M, 140Y and 140K of the nozzle surface wiping unit 86 to transport the unnapped wiping web 142. Herein, the cleaning controller 154 does not cause a cleaning liquid to be applied to the unnapped wiping web 142, and lets the unnapped wiping web 142 stay in the dry state.

In this state, the head movement controller 150 controls the head moving unit 36 to move the ink jet heads 32C, 32M, 32Y, and 32K from the maintenance position to the image recording position.

Accordingly, the unnapped wiping web 142 of each of the nozzle surface wiping devices 140C, 140M, 140Y, and 140K, which is in the dry state, is pressed and abutted against each of the nozzle surfaces 202 of the moving ink jet heads 32C, 32M, 32Y, and 32K via the press roller 110, thereby wiping and cleaning the nozzle surfaces 202.

Next, in Step S5 (an example of after cleaning by the second cleaning unit), the ink jet heads 32C, 32M, 32Y, and 32K again perform pre-jetting (an example of a second pre-jetting control step).

That is, the cleaning controller 154 moves the nozzle surface wiping unit 86 to the retracted position. In addition, the head movement controller 150 moves the ink jet heads 32C, 32M, 32Y, and 32K to the maintenance position. The second pre-jetting controller 160 of the maintenance controller 156 controls the ink jet heads 32C, 32M, 32Y, and 32K to pre-jet an ink 200 times per nozzle 214. Herein, pre-jetting may be performed from all of the nozzles 214 at once, or pre-jetting may be performed by each group divided as in Step S3.

The pre-jetting is executed in order to remove foreign substances that are inside the nozzles 214 and cannot be removed through wiping by the unnapped wiping web 142. For this reason, the pre-jetting can fulfill a role thereof insofar as the number of times of jetting allows the entire ink inside the nozzles 214 to be jetted.

With this, the cleaning of the ink jet heads 32C, 32M, 32Y and 32K is finished.

<Verification of Number of Times of Jetting in Pre-Jetting>

Figure 16:
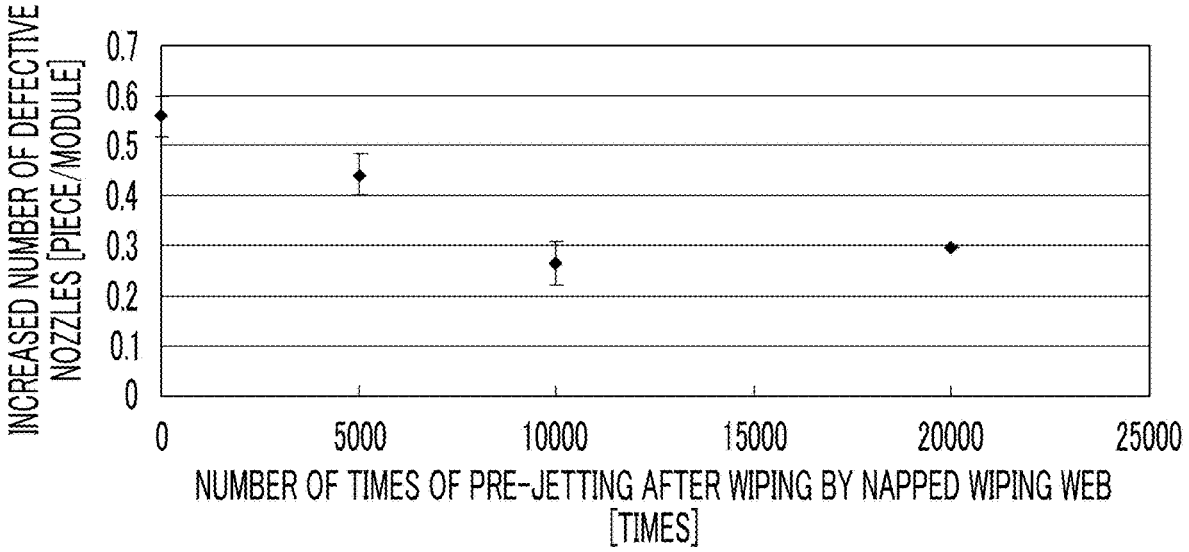
FIG. 16 is a graph showing a relationship between the number of times of jetting in pre-jetting after wiping by the napped wiping web and an increased number of defective nozzles after cleaning is finished.

FIG. 16 is a graph showing a relationship between the number of times of jetting per nozzle in the pre-jetting (Step S3 of FIG. 13) after wiping by the napped wiping web 104 and an increased number of defective nozzles per head module after cleaning is finished. Herein, the number of times of jetting in the pre-jetting after wiping by the unnapped wiping web 142 (Step S5 of FIG. 13) is 200 times.

As shown in FIG. 16, an increased number of defective nozzles decreases as pre-jetting is performed. Specifically, the increased number of defective nozzles is decreased by 20 percent or more in a case where the number of times of jetting is 5,000 times, and the increased number of defective nozzles is decreased by 50 percent or more in a case where the number of times of jetting is decreased to 10,000 times, In addition, it is clear that recovery can be made in a case where the number of times of jetting is 10,000 times or more. Therefore, the number of times of jetting in pre-jetting after the wiping by the napped wiping web 104 is preferably 5,000 times or more per nozzle, and more preferably, 10,000 times or more per nozzle.

In a case of performing pre-jetting 10,000 times or more and an ink is jetted from all of the nozzles 214 at once, there is a possibility that more mist adheres to the nozzle surfaces 202 and liquid repellent films of the nozzle surface 202 degrade due to the ink. Therefore, it is preferable that the nozzles are divided and jet an ink for each group as described above.

Figure 17:
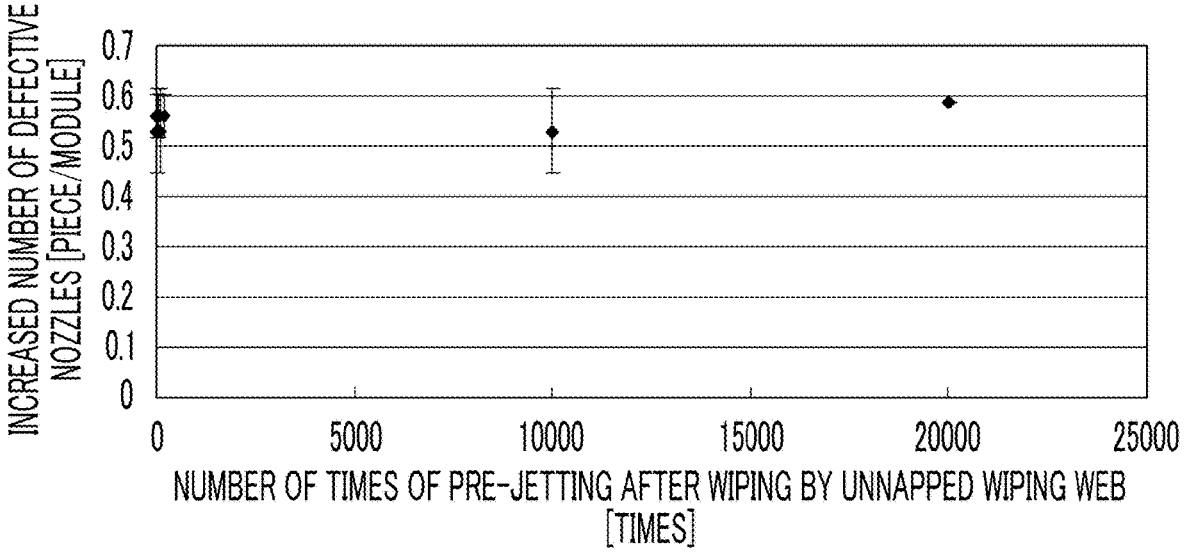
FIG. 17 is a graph showing a relationship between the number of times of jetting in pre-jetting after wiping by an unnapped wiping web and an increased number of defective nozzles after cleaning is finished.

FIG. 17 is a graph showing a relationship between the number of times of jetting per nozzle in the pre-jetting (Step S5 of FIG. 13) after wiping by the unnapped wiping web 142 and an increased number of defective nozzles per head module after cleaning is finished, in a case where the number of times of jetting per nozzle in pre-jetting (Step S3 of FIG. 13) after wiping by the napped wiping web 104 is set to 0 time (none). In addition, FIG. 18 is an enlarged graph of a portion where the number of times of jetting is 0 to 300 times in the pre-jetting of FIG. 17.

Figure 18:
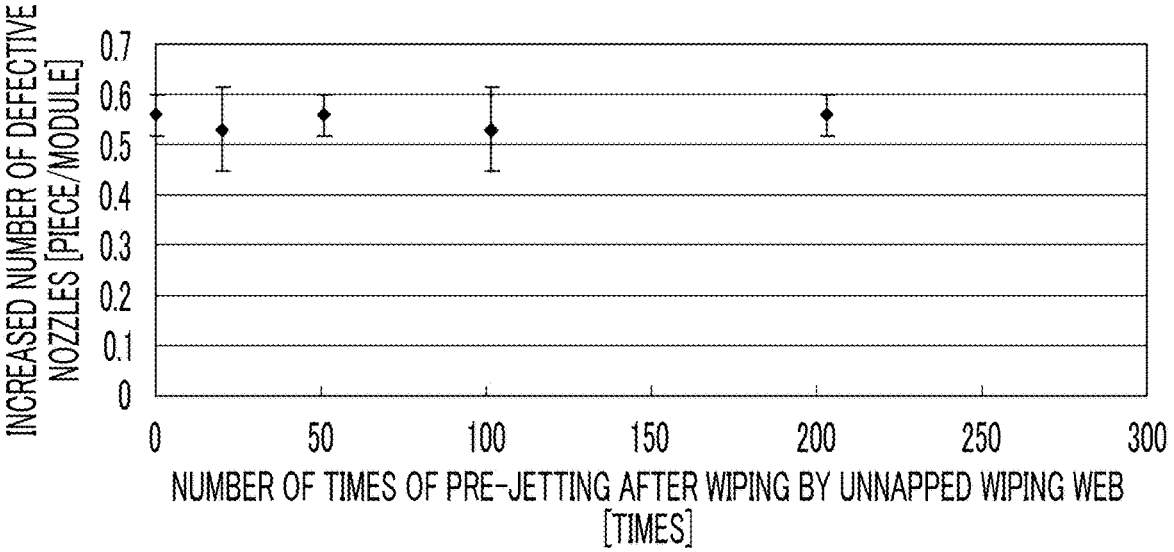
FIG. 18 is a graph showing the relationship between the number of times of jetting in pre-jetting after wiping by the unnapped wiping web and the increased number of defective nozzles after cleaning is finished.

As shown in FIGS. 17 and 18, no significant improvement is seen even in a case where the number of times of jetting in pre-jetting has increased. Therefore, the number of times of jetting in the pre-jetting after wiping by the unnapped wiping web 142 is preferably 200 times or less per nozzle, more preferably, 100 times or less per nozzle, and even more preferably, 50 times or less per nozzle. It is sufficient that dirt inside the nozzles 214 can be jetted through the pre-jetting. Therefore, it is sufficient that an ink corresponding to the amount of ink inside the nozzle communication passage 232 can be jetted.

As described above, it is preferable that the number of times of jetting in the pre-jetting after wiping by the napped wiping web 104 is larger than the number of times of jetting in the pre-jetting after wiping by the unnapped wiping web 142. In addition, it is more preferable that the number of times of jetting in the pre-jetting after wiping by the napped wiping web 104 is 10,000 times or more.

<Another Form of Cleaning Method>

Figure 19:
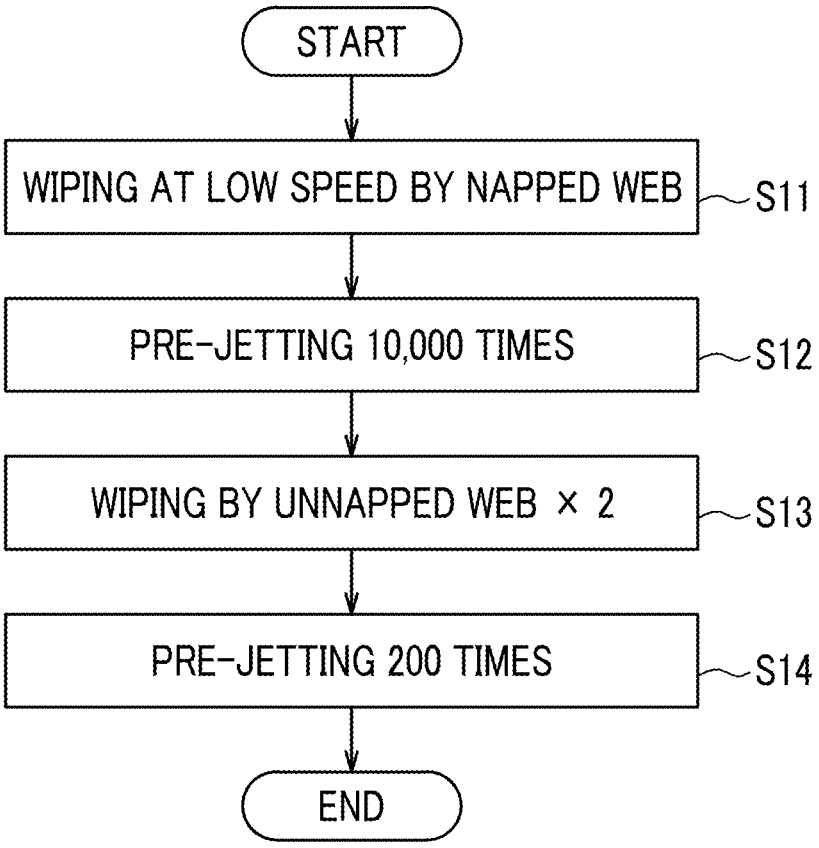
FIG. 19 is a flowchart showing processing of the head cleaning method.

FIG. 19 is a flowchart showing another form of processing of a cleaning method of the head 32 by the ink jet recording device 10.

Herein, cleaning after the head 32 has performed pressurization purging at the maintenance position will be described. The pressurization purging is controlled by the pressurization purging controller 164 of the maintenance controller 156. The pressurization purging is performed in order to remove an ink of which viscosity inside the nozzles 214 has risen and an ink fixed to the vicinity of the nozzles 214.

In a case where pressurization purging is finished, the nozzle surface wiping unit 82 wipes the nozzle surfaces 202 of the head 32 at a low speed in Step S11, That is, the cleaning controller 154 moves the nozzle surface wiping unit 82 to the wiping position and moves the nozzle surface wiping unit 86 to the retracted position. In addition, the cleaning controller 154 causes the web transporting unit 102 of each of the nozzle surface wiping devices 100C, 100M, 100Y, and 100K of the nozzle surface wiping unit 82 to transport the napped wiping web 104. Herein, the cleaning controller 154 does not cause a cleaning liquid to be applied to the napped wiping web 104, and lets the napped wiping web 104 stay in the dry state.

In this state, the head movement controller 150 controls the head moving unit 36 to move the ink jet heads 32C, 32M, 32Y, and 32K from the maintenance position to the image recording position. Herein, the ink jet heads are moved at a speed lower than moving speeds of the ink jet heads 32C, 32M, 32Y, and 32K in Step S1 of FIG. 13.

Accordingly, the napped wiping web 104 to which a cleaning liquid is not applied, is pressed and abutted against each of the nozzle surfaces 202 of the moving ink jet heads 32C, 32M, 32Y, and 32K via the press roller 110, thereby wiping and cleaning the nozzle surfaces 202. The nozzle surfaces 202 after pressurization purging are wet with an ink. Therefore, as the napped wiping web 104 in the dry state performs wiping at a low speed, the nozzle surfaces 202. can be cleaned by the napped wiping web 104 absorbing the ink on the nozzle surfaces 202.

In addition, the napped wiping web 104 has the napped yarn 104R. Therefore, dirt inside the nozzles 214 can be removed by the napped yarn 104R entering the inside of the nozzles 214 in a case where the napped wiping web 104 wipes the nozzle surfaces 202.

Next, in Step S12, the first pre-jetting controller 158 of the maintenance controller 156 controls the ink jet heads 32C, 32M, 32Y, and 32K to pre-jet an ink 10,000 times per nozzle 214. Prior to pre-jetting, the cleaning controller 154 moves the nozzle surface wiping unit 86 to the retracted position, and the head movement controller 150 moves the ink jet head 32 from the image recording position to the maintenance position.

Pre-jetting herein requires the number of times of jetting sufficient to blow off an object adhered to the nozzles 214. In addition, as in Step S3 of FIG. 13, out of the plurality of nozzles 214 in the same nozzle lines 218A and 218B, the nozzles 214 adjacent to each other are divided into a plurality of groups so as to belong to groups different from each other, and the nozzles 214 pre-jet an ink at time points different for each group. By pre-jetting in this manner, adherence of mist to the nozzle surfaces 202 can be suppressed.

Next, in Step S13, the nozzle surface wiping unit 86 wipes the nozzle surfaces 202 of the ink jet heads 32C, 32M, 32Y, and 32K two times.

That is, the cleaning controller 154 moves the nozzle surface wiping unit 86 to the wiping position. In addition, the cleaning controller 154 causes the web transporting unit 102 of each of the nozzle surface wiping devices 140C, 140M, 140Y, and 140K of the nozzle surface wiping unit 86 to transport the unnapped wiping web 142. The cleaning controller 154 does not cause a cleaning liquid to be applied to the unnapped wiping web 142, and lets the unnapped wiping web 142 stay in the dry state.

In this state, the head movement controller 150 controls the head moving unit 36 to move the ink jet heads 32C, 32M, 32Y, and 32K from the maintenance position to the image recording position.

Accordingly, the unnapped wiping web 142 of each of the nozzle surface wiping devices 140C, 140M, 140Y, and 140K, which is in the dry state, is pressed and abutted against each of the nozzle surfaces 202 of the moving ink jet heads 32C, 32M, 32Y, and 32K via the press roller 110, thereby performing the first wiping and cleaning of the nozzle surfaces 202.

Next, the cleaning controller 154 moves the nozzle surface wiping unit 86 to the retracted position, and causes the web transporting unit 102 of each of the nozzle surface wiping devices 140C, 140M, 140Y, and 140K of the nozzle surface wiping unit 86 to stop transporting the unnapped wiping web 142. In this state, the head movement controller 150 moves the head 32 from the image recording position to the maintenance position.

Next, the cleaning controller 154 moves the nozzle surface wiping unit 86 to the wiping position. In addition, the cleaning controller 154 causes the web transporting unit 102 of each of the nozzle surface wiping devices 140C, 140M, 140Y, and 140K of the nozzle surface wiping unit 86 to transport the unnapped wiping web 142. As in the first cleaning and wiping, the cleaning controller 154 does not cause a cleaning liquid to be applied to the unnapped wiping web 142, and lets the unnapped wiping web 142 stay in the dry state.

In this state, the head movement controller 150 controls the head moving unit 36 to move the ink jet heads 32C, 32M, 32Y, and 32K from the maintenance position to the image recording position.

Accordingly, the unnapped wiping web 142 of each of the nozzle surface wiping devices 140C, 140M, 140Y, and 140K, which is in the dry state, is pressed and abutted against each of the nozzle surfaces 202 of the moving ink jet heads 32C, 32M, 32Y, and 32K via the press roller 110, thereby performing the second wiping and cleaning of the nozzle surfaces 202.

Lastly, in Step S14, the ink jet heads 32C, 32M, 32Y, and 32K again perform pre-jetting.

That is, the cleaning controller 154 moves the nozzle surface wiping unit 86 to the retracted position. In addition, the head movement controller 150 moves the ink jet heads 32C, 32M, 32Y, and 32K. to the maintenance position. The second pre-jetting controller 160 of the maintenance controller 156 controls the ink jet heads 32C, 32M, 32Y, and 32K to pre-jet an ink 200 times per nozzle 214.

The pre-jetting is executed in order to remove foreign substances that are inside the nozzles 214 and cannot be removed through wiping by the unnapped wiping web 142. For this reason, the pre-jetting can fulfill a role thereof insofar as the number of times of jetting allows the entire ink inside the nozzles 214 to be jetted.

With this, the cleaning of the ink jet heads 32C, 32M, 32Y, and 32K is finished.

<Others>

It is possible to configure the cleaning method as a program for causing a computer to realize each step, and it is also possible to configure the cleaning method as a non-temporary recording medium in which the program is stored, such as a compact disk-read only memory (CD-ROM).

In the embodiment described hereinbefore, hardware structures of processing units that execute various types of processing, for example, the head movement controller 150, the recording controller 152, the cleaning controller 154, and the maintenance controller 156, are various types of processors as follows. The various types of processors include a central processing unit (CPU) which is a general-purpose processor that executes software (program) to function as the various types of processing units, a programmable logic device (PLD) which is a processor having a circuit configuration that is changeable after manufacturing, such as a field programmable gate array (FPGA), and a dedicated electrical circuit which is a processor having a circuit configuration exclusively designed for executing certain processing, such as an application specific integrated circuit (ASIC).

One processing unit may be configured by one of the various types of processors, or may be configured by the same type or different types of two or more processors (for example, a plurality of FPGAs, or a combination of a CPU and an FPGA). In addition, a plurality of processing units may be configured by one processor. As an example of configuring the plurality of processing units by one processor, firstly, there is a form in which one processor is configured by a combination of one or more CPUs and software so as to be represented by a computer such as a server and a client and the processor functions as the plurality of processing units. Secondly, there is a form in which a processor that realizes a function of the entire system, including the plurality of processing units, with one integrated circuit (IC) chip is used so as to be represented by a system on chip (SoC). As described above, the various types of processing units are configured by using one or more of the various types of processors as the hardware structures.

More specifically, hardware structures of the various types of processors are electrical circuits (circuitry) obtained by combining circuit elements such as a semiconductor element.

The technical scope of the present invention is not limited to the scope described in the embodiment. Configurations of the respective embodiments can be combined between the respective embodiments as appropriate without departing from the gist of the present invention.

EXPLANATION OF REFERENCES

10: ink jet recording device
20: sheet transporting unit
22: belt
30: head unit
32: head
32C: ink jet head
32K: ink jet head
32M: ink jet head
32Y: ink jet head
34: head supporting frame
36: head moving unit
50: maintenance unit
52: cap
52C: cap
52K: cap
52M: cap
52Y: cap
54: waste liquid tray
56: waste liquid collecting piping
58: waste liquid tank
80: nozzle surface cleaning unit
82: nozzle surface wiping unit
84: stand
86: nozzle surface wiping unit
88: stand
100: nozzle surface wiping device
100C: nozzle surface wiping device
100K: nozzle surface wiping device
100M: nozzle surface wiping device
100Y: nozzle surface wiping device
102: web transporting unit
104: napped wiping web
104A: ground weave part
104B: napped part
104R: napped yam
106: supply shaft
108: winding shaft
110: press roller
112: first guide roller
114: second guide roller
116: winding motor
120: cleaning liquid applying unit
122: cleaning liquid supplying nozzle
124: cleaning liquid tank
126: cleaning liquid flow passage
128: cleaning liquid pump
140: nozzle surface wiping device
140C: nozzle surface wiping device
140K: nozzle surface wiping device
140M: nozzle surface wiping device
140Y: nozzle surface wiping device
142: unnapped wiping web
150: head movement controller
152: recording controller
154: cleaning controller
156: maintenance controller
158: first pre-jetting controller
160: second pre-jetting controller
162: third pre-jetting controller
164: pressurization purging controller
200: head module
200-1: head module
**200-*n***: head module
202: nozzle surface
204: nozzle plate
206: ink supplying chamber
208: ink circulating chamber
210: supply pipe line
212: circulation pipe line
214: nozzle
214_1: nozzle
214_2: nozzle
214_3: nozzle
214_4: nozzle
214_5 nozzle
214_6: nozzle
214_7: nozzle
214_8: nozzle
216A: first block

216B: second block
218A: nozzle line
218B: nozzle line
220A: supply flow passage
220B: supply flow passage
222A: main flow passage
222B: main flow passage
224: flow passage structure
226: common supply flow passage
228: individual supply passage
230: pressure chamber
232: nozzle communication passage
234: individual circulation flow passage
236: common circulation flow passage
238: diaphragm
240: bonded layer
242: lower electrode
244: piezoelectric layer
246: upper electrode
248: piezoelectric element
250: supply port
252: discharge port
300: ink circulating unit
302: circulation tank
304: ink supply flow passage
306: supply pump
308: ink collection flow passage
310: collection pump
312: replenishment tank
314: ink replenishment flow passage
316: replenishment pump
P: sheet
S1 to S14: processing of liquid jetting head cleaning method

What is claimed is:

1. A liquid jetting head cleaning device comprising:

a first cleaning unit that cleans a liquid jetting head by causing a napped wiping member to abut against a nozzle surface of the liquid jetting head of a liquid jetting device having a liquid tank which stores a liquid containing latex, the liquid jetting head which jets the liquid from a nozzle disposed on the nozzle surface, and a circulating unit which circulates the liquid between the liquid tank and the liquid jetting head;

a first pre-jetting controller that causes the liquid to be pre-jetted from the nozzle of the liquid jetting head after cleaning by the first cleaning unit;

a second cleaning unit that cleans the liquid jetting head by causing an unnapped wiping member to abut against the nozzle surface of the liquid jetting head after pre-jetting by the first pre-jetting controller; and a second pre-jetting controller that causes the liquid to be pre-jetted from the nozzle of the liquid jetting head after cleaning by the second cleaning unit, wherein the number of times of jetting in pre-jetting by the first pre-jetting controller is larger than the number of times of jetting in pre-jetting by the second pre-jetting controller.

2. The liquid jetting head cleaning device according to claim 1, wherein the first pre-jetting controller causes the liquid to be pre-jetted 10,000 times or more per nozzle.

3. The liquid jetting head cleaning device according to claim 1, wherein the second pre-jetting controller causes the liquid to be pre-jetted 200 times or less per nozzle.

4. The liquid jetting head cleaning device according to claim 1, further comprising:

a third pre-jetting controller that causes the liquid to be pre-jetted from the nozzle, wherein the first cleaning unit cleans the liquid jetting head by using the napped wiping member in a wet state after pre-jetting by the third pre-jetting controller.

5. The liquid jetting head cleaning device according to claim 1, further comprising:

a pressurization purging controller that performs pressurization purging for pressurizing an inside of the liquid jetting head to discharge the liquid from the nozzle, wherein the first cleaning unit cleans the liquid jetting head by using the napped wiping member in a dry state after the pressurization purging.

6. The liquid jetting head cleaning device according to claim 1, wherein the liquid jetting head is provided with a supply flow passage through which the liquid is supplied to a plurality of the nozzles, the plurality of the nozzles are divided into a plurality of groups, and out of the plurality of the nozzles to which the liquid is supplied from the same supply flow passage, the nozzles adjacent to each other belong to groups different from each other, and the first pre-jetting controller causes the liquid to be pre-jetted from the nozzles at time points different for each of the groups.

7. The liquid jetting head cleaning device according to claim 6, wherein the liquid jetting head is provided with a circulation flow passage through which the liquid is collected from the plurality of the nozzles, and the circulating unit supplies the liquid from the liquid tank to the supply flow passage and collects the liquid from the circulation flow passage to the liquid tank.

8. The liquid jetting head cleaning device according to claim 1, wherein the napped wiping member is a long wiping web, and the first cleaning unit causes the wiping web to abut against the nozzle surface via an abutting member, transports the wiping web with respect to the abutting member in a first direction, and moves the liquid jetting head relative to the abutting member in a second direction parallel to the nozzle surface to clean the liquid jetting head.

9. A liquid jetting device comprising:

a liquid tank that stores a liquid containing latex;

a liquid jetting head that jets the liquid from a nozzle disposed on a nozzle surface;

a circulating unit that circulates the liquid between the liquid tank and the liquid jetting head;

a transporting unit that transports a recording medium;

a recording controller that causes the liquid to be jetted from the nozzle of the liquid jetting head to the transported recording medium to record an image on the recording medium;

a first cleaning unit that cleans the liquid jetting head by causing a napped wiping member to abut against the nozzle surface of the liquid jetting head;

a first pre-jetting controller that causes the liquid to be pre-jetted from the nozzle of the liquid jetting head after cleaning by the first cleaning unit;

a second cleaning unit that cleans the liquid jetting head by causing an unnapped wiping member to abut against the nozzle surface of the liquid jetting head after pre-jetting by the first pre-jetting controller; and a second pre-jetting controller that causes the liquid to be pre-jetted from the nozzle of the liquid jetting head after cleaning by the second cleaning unit, wherein the number of times of jetting in pre-jetting by the first pre-jetting controller is larger than the number of times of jetting in pre-jetting by the second pre-jetting controller.

10. The liquid jetting device according to claim 9, further comprising:

a maintenance unit that comprises a liquid receiving unit which receives the liquid caused to be pre-jetted by the first pre-jetting controller and the liquid caused to be pre-jetted by the second pre-jetting controller; and a moving unit that moves the liquid jetting head between a recording position facing the transporting unit and a maintenance position facing the maintenance unit, wherein the first cleaning unit and the second cleaning unit are disposed between the recording position and the maintenance position.

11. The liquid jetting device according to claim 10, wherein the liquid receiving unit is a moisturization cap that stores a moisturizing liquid and covers the nozzle surface to form a moisturization space between the nozzle surface and the moisturization cap.

12. A liquid jetting head cleaning method comprising:

a first cleaning step of cleaning a liquid jetting head by causing a napped wiping member to abut against a nozzle surface of the liquid jetting head of a liquid jetting device that has a liquid tank which stores a liquid containing latex, the liquid jetting head which jets the liquid from a nozzle disposed on the nozzle surface, and a circulating unit which circulates the liquid between the liquid tank and the liquid jetting head;

a first pre-jetting control step of causing the liquid to be pre-jetted from the nozzle of the liquid jetting head after cleaning in the first cleaning step;

a second cleaning step of cleaning the liquid jetting head by causing an unnapped wiping member to abut against the nozzle surface of the liquid jetting head after pre-jetting in the first pre-jetting control step; and a second pre-jetting control step of causing the liquid to be pre-jetted from the nozzle of the liquid jetting head after cleaning in the second cleaning step, wherein the number of times of jetting in pre-jetting of the first pre-jetting control step is larger than the number of times of jetting in pre-jetting of the second pre-jetting control step.

* * * * *